US010749267B2

(12) United States Patent
Sone

(10) Patent No.: US 10,749,267 B2
(45) Date of Patent: Aug. 18, 2020

(54) ANTENNA DEVICE FOR VEHICLE

(71) Applicant: YOKOWO CO., LTD., Tokyo (JP)

(72) Inventor: Takayuki Sone, Tomioka (JP)

(73) Assignee: YOKOWO CO., LTD., Tokyo (JP)

( * ) Notice: Subject to any disclaimer, the term of this patent is extended or adjusted under 35 U.S.C. 154(b) by 0 days.

(21) Appl. No.: 16/308,506

(22) PCT Filed: Jun. 8, 2017

(86) PCT No.: PCT/JP2017/021393
§ 371 (c)(1),
(2) Date: Dec. 10, 2018

(87) PCT Pub. No.: WO2017/213243
PCT Pub. Date: Dec. 14, 2017

(65) Prior Publication Data

US 2019/0273310 A1 Sep. 5, 2019

(30) Foreign Application Priority Data

Jun. 10, 2016 (JP) ..... 2016-116717

(51) Int. Cl.
*H01Q 19/24* (2006.01)
*H01Q 1/32* (2006.01)
(Continued)

(52) U.S. Cl.
CPC ..... *H01Q 19/24* (2013.01); *H01Q 1/32* (2013.01); *H01Q 9/065* (2013.01); *H01Q 21/062* (2013.01); *H01Q 21/08* (2013.01)

(58) Field of Classification Search
CPC ..... H01Q 1/32; H01Q 1/3275; H01Q 9/065; H01Q 9/16; H01Q 9/285; H01Q 21/062
See application file for complete search history.

(56) References Cited

U.S. PATENT DOCUMENTS 6,008,773 A 12/1999 Matsuoka et al.
2003/0214445 A1* 11/2003 Hsiao ..... H01Q 1/38 343/700 MS
(Continued)

FOREIGN PATENT DOCUMENTS

CN 105006660 A 10/2015
CN 207021376 U 2/2018
(Continued)

OTHER PUBLICATIONS

English-language translation of International Search Report and Written Opinion for International Application No. PCT/JP2017/021393, dated Aug. 22, 2017.
(Continued)

*Primary Examiner* — Daniel Munoz
(74) *Attorney, Agent, or Firm* — Xsensus LLP

(57) ABSTRACT

Provided is a linear polarization array antenna device for vehicle that is low-cost and has a high gain, by forming an array antenna and a transmission line by conductor patterns on a substrate. The present invention is provided with: a dipole antenna array in which a plurality of dipole antennas formed by the conductor patterns provided on a dielectric substrate are arranged; and two parallel transmission lines formed by the conductor patterns provided on the dielectric substrate, wherein power is supplied to the dipole antennas via the transmission lines. The two parallel transmission lines have a structure in which a pair of conductor patterns face each other across the dielectric substrate interposed between the pair of the conductor patterns.

17 Claims, 34 Drawing Sheets

(51) Int. Cl.

| | |
|---|---|
| ***H01Q 21/08*** | (2006.01) |
| ***H01Q 21/06*** | (2006.01) |
| ***H01Q 9/06*** | (2006.01) |

(56) References Cited

U.S. PATENT DOCUMENTS

| | | | | |
|---|---|---|---|---|
| 2005/0073465 | A1* | 4/2005 | Olson | H01Q 1/38 343/795 |
| 2006/0232488 | A1* | 10/2006 | Wang | H01Q 1/242 343/795 |
| 2007/0290938 | A1* | 12/2007 | Loyet | H01Q 1/246 343/795 |
| 2009/0195471 | A1* | 8/2009 | Semonov | H01Q 1/246 343/810 |
| 2010/0033396 | A1 | 2/2010 | Tanabe et al. | |
| 2011/0284641 | A1 | 11/2011 | Yang | |
| 2015/0097738 | A1 | 4/2015 | Sugimoto et al. | |

FOREIGN PATENT DOCUMENTS

| | | | |
|---|---|---|---|
| JP | H08-204433 | A | 8/1996 |
| JP | H10-150319 | A | 6/1998 |
| JP | H11-284425 | A | 10/1999 |
| JP | 2010-074809 | A | 4/2010 |
| JP | 5874780 | B2 | 3/2016 |
| WO | 2008-136455 | A1 | 11/2008 |

OTHER PUBLICATIONS

Office Action issued in Chinese Application 201710427913.5 dated Nov. 21, 2019.

* cited by examiner

GAIN [dBi] IN X-Y PLANE (HORIZONTAL PLANE)
OF VERTICAL POLARIZED WAVE AT 5887.5 MHz

AVERAGE GAIN -0.86 dBi

GAIN [dBi] IN X-Y PLANE (HORIZONTAL PLANE)
OF VERTICAL POLARIZED WAVE AT 5925 MHz

AVERAGE GAIN -0.85 dBi

ANTENNA DEVICE FOR VEHICLE

CROSS-REFERENCE TO RELATED APPLICATIONS

This application is a National Stage Application based on PCT/JP2017/021393, filed on 8 Jun. 2017, and claims priority to Japanese Patent Application No. 2016-116717, filed on 10 Jun. 2016, the entire contents of each of which being incorporated herein by reference.

TECHNICAL FIELD

The present invention relates to an antenna device for vehicle which is mounted on a vehicle and is used for V2X (Vehicle to X; Vehicle to Everything) communication (such as vehicle-to-vehicle communication and vehicle-to-road-side communication) and so on.

BACKGROUND ART

In the past, monopole antennae and sleeve antennae have been considered as V2X antennae. In FIG. 22 to FIG. 26, the configuration, VSWR (Voltage Standing Wave Ratio), and gain in horizontal plane (X-Y plane) of a monopole antenna are shown, and in FIGS. 27A and 27B to FIG. 31, the configuration, VSWR, and gain in horizontal plane of a sleeve antenna are shown.

With reference to FIG. 22 to FIG. 26, a monopole antenna will be described. FIG. 22 shows the case where a monopole antenna 1 is installed vertically on a circular ground plate 5 (a circular conductor plate having a diameter of 1 m), and as shown in FIG. 23, the VSWR in this case is 1.4209 at a frequency of 5850 MHz, and is 1.4076 at a frequency of 5887.5 MHz, and is 1.4045 at a frequency of 5925 MHz. In the case where orthogonal coordinates X, Y, and Z are defined as shown in FIG. 22, the gain in horizontal plane of vertical polarized wave (Vertical Polarization) at 5850 MHz is shown in FIG. 24, and the average gain is −0.87 dBi. Also, the gain in horizontal plane of vertical polarized wave at 5887.5 MHz is shown in FIG. 25, and the average gain is −0.86 dBi, and the gain in horizontal plane of vertical polarized wave at 5925 MHz is shown in FIG. 26, and the average gain is −0.85 dBi. Like this, the monopole antenna (in the case where the monopole antenna is installed vertically on a circular ground plate having a diameter of 1 m, the average gain of vertical polarized wave is about −0.9 dBi) has the disadvantage that when the monopole antenna is installed on the roof of a vehicle body or the like, it cannot satisfy specifications required for V2X communication.

With reference to FIGS. 27A and 27B to FIG. 31, a sleeve antenna will be described. In the case where a sleeve antenna 2 shown in the front view of FIG. 27A and the cross-sectional view of FIG. 27B is installed vertically on a circular ground plate 5, as shown in FIG. 28, the VSWR is 1.0771 at the frequency of 5850 MHz, and is 1.0577 at the frequency of 5887.5 MHz, and is 1.0839 at the frequency of 5925 MHz. In the case where orthogonal coordinates X, Y. and Z are defined as shown in FIG. 27A, the gain in horizontal plane of vertical polarized wave at 5850 MHz is shown in FIG. 29, and the average gain is 2.27 dBi. Also, the gain in horizontal plane of vertical polarized wave at 5887.5 MHz is shown in FIG. 30, and the average gain is 2.35 dBi, and the gain in horizontal plane of vertical polarized wave at 5925 MHz is shown in FIG. 31, and the average gain is 2.38 dBi. Like this, the sleeve antenna has higher gain as compared to the monopole antenna, but has the disadvantage that mechanism design becomes difficult and the cost increases since it is required to three-dimensionally configure a coaxial structure and a sleeve structure with high accuracy.

By the way, Patent Document 1 mentions about a monopole antenna for V2X communication.

PRIOR ART DOCUMENT

Patent Document

[Patent Document 1] Japanese Patent No. 5874780

SUMMARY OF INVENTION

Problems to be Solved by Invention

As described above, monopole antennae have the problem that the gain is low, and sleeve antennae have high gain but have the problem that mechanism design is difficult and the cost increases.

The present invention has been made in view of those circumstances, and an object of the present invention is to provide a low-cost antenna device for vehicle having high gain by forming an array antenna and transmission lines by conductor patterns on a substrate.

Means for Solving Problems

According to a first aspect of the present invention, an antenna device for vehicle includes one or more dipole antenna arrays in which a plurality of dipole antennae which have conductor patterns provided on a substrate are arranged, and two parallel transmission lines having conductor patterns provided on the substrate, wherein each of the dipole antennae is power-fed via the transmission lines.

According to a second aspect of the present invention, in the first aspect, the dipole antenna arrays may include a pair of dipole antenna arrays, on one side of the substrate in a width direction of the substrate, one of the dipole antenna arrays may be disposed, and on the other side of the substrate in the width direction of the substrate, the other of the dipole antenna arrays may be disposed.

According to a third aspect of the present invention, in the first or second aspect, on the substrate, a conductor pattern which constitutes a wave director or a reflector may be provided in parallel with at least one of the dipole antenna arrays.

According to a fourth aspect of the present invention, in any one of the first to third aspects, the dipole antenna arrays may be a straight line arrangement of the plurality of dipole antennae.

Also, according to a fifth aspect of the present invention, in the second aspect, the dipole antenna arrays may be a straight line arrangement of the plurality of dipole antennae, and when a free space wavelength of radio transmission or reception waves is $\lambda$, the interval between one of the dipole antenna arrays and the other of the dipole antenna arrays may be $\lambda/2$.

According to a sixth aspect of the present invention, in any one of the first to fifth aspects, the transmission lines may include a common transmission line part which is used in common for power-feeding to all of the dipole antennae, and branch transmission line parts which branch from the common transmission line part and are used for power-feeding to the individual dipole antennae.

According to a seventh aspect of the present invention, in any one of the first to sixth aspects, the two parallel transmission lines may have a structure in which a pair of conductor patterns face each other across the substrate interposed between the pair of the conductor patterns.

Also, according to an eighth aspect of the present invention, in the seventh aspect, a conductor pattern provided on one surface of the substrate and constituting one side element of the dipole antennae may be connected to one of the conductor patterns of the transmission lines, provided on said one surface of the substrate, and a conductor pattern provided on the other surface of the substrate and constituting the other side element of the dipole antennae may be connected to the other of the conductor patterns of the transmission lines, provided on the other surface of the substrate.

According to a ninth aspect of the present invention, in any one of the first to eighth aspects, the substrate may be mounted vertically on a mounting member fixed on a base, and a case may be put on the base from above so as to cover the substrate.

Also, according to a tenth aspect of the present invention, in the ninth aspect, both surfaces of the substrate may have conductor lands which are fixed to the mounting member by soldering, and the conductor lands may be connected to each other via a through-hole.

According to an eleventh aspect of the present invention, in any one of the first to tenth aspects, the transmission lines may include a common transmission line part which is used in common for power-feeding to all of the dipole antennae, and branch transmission line parts which branch from the common transmission line part and are used for power-feeding to the respective dipole antennae, and the common transmission line part may be a reflector.

According to a twelfth aspect of the present invention, in any one of the first to third aspects, a position of a connection part between at least one of the dipole antennae and the transmission lines may be different from a position of a connection part between the other of the dipole antennae and the transmission lines, in a direction perpendicular to an arrangement direction of the other of the dipole antennae.

According to a thirteenth aspect of the present invention, in any one of the first to third aspects, at least one of the dipole antennae may be inclined with respect to an arrangement direction of the other of the dipole antennae.

According to a fourteenth aspect of the present invention, in the seventh aspect, a conductor pattern provided on one surface of the substrate and constituting one side element of the dipole antennae may be connected to one of the conductor patterns of the transmission lines, provided on said one surface of the substrate, and the other of the conductor patterns of the transmission lines, provided on the other surface of the substrate may be surrounded by a conductor pattern provided on the other surface of the substrate and constituting the other side element of the dipole antennae.

Also, arbitrary combinations of the above-mentioned components, and a configuration which is obtained by replacing an expression of the present invention with another one in between methods, systems, and the like are also effective as an aspect of the present invention.

Advantageous Effects of Invention

According to the antenna device for vehicle of the present invention, since the dipole antenna array and the transmission lines are formed on the substrate, it is possible to obtain high gain and reduce the manufacturing cost.

EMBODIMENTS OF INVENTION

Figure 1A:
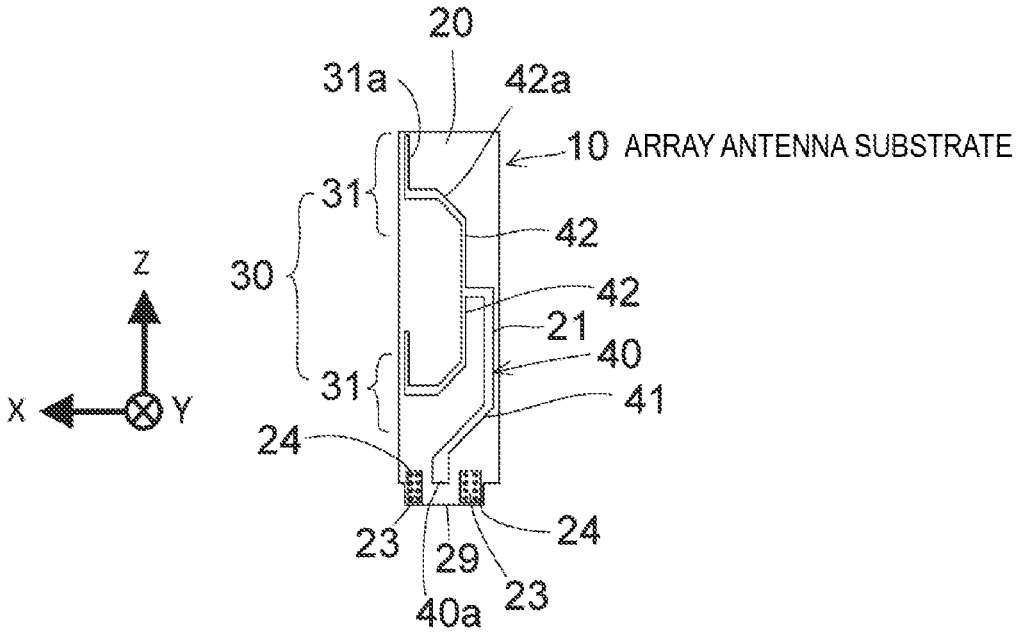
FIG. 1A A diagram illustrating a first surface of an array antenna substrate according to a first embodiment in the case of configuring an linear polarized wave array antenna device for vehicle as an antenna device for vehicle according to the present invention.

Hereinafter, preferred embodiments of the present invention will be described in detail with reference to the drawings. Identical or equivalent components, members, processes, and the like shown in the drawings are denoted by the same reference symbols, and redundant descriptions thereof will be omitted as appropriate. Also, the embodiments do not limit the invention, and are examples, and all features which are described in the embodiments and combinations thereof are not necessarily essential for the invention.

Figure 1B:
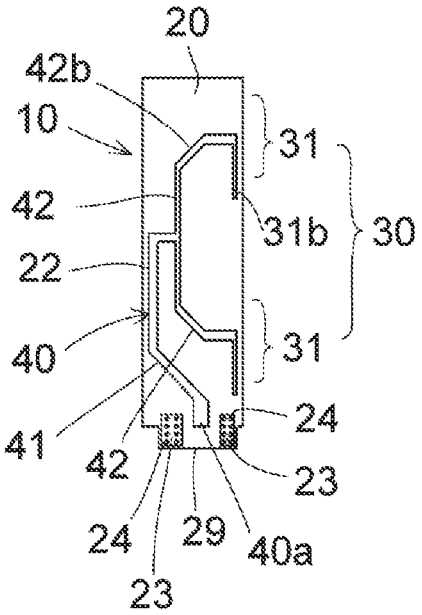
FIG. 1B A diagram illustrating a second surface of the array antenna substrate according to the first embodiment.
Figure 6:
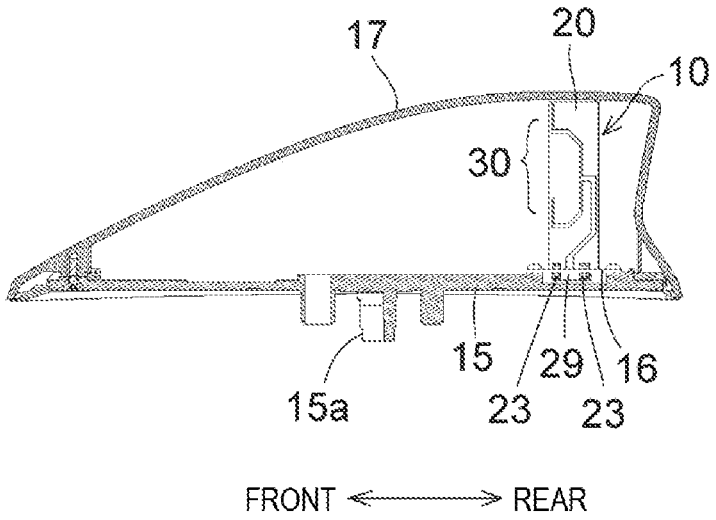
FIG. 6 A sectional side view illustrating the overall configuration of the first embodiment in a state where the array antenna substrate is accommodated in a case having a shark-fin shape.

FIG. 1A and FIG. 1B show an array antenna substrate 10 according to a first embodiment in the case of configuring a linear polarized wave array antenna device for vehicle as an antenna device for vehicle according to the present invention. This array antenna substrate 10 is mounted vertically on a mounting substrate (a mounting member) 16 fixed on a base 15 as shown in FIG. 6, and a case 17 having, for example, a shark fin shape is put on the base 15 from above so as to cover the array antenna substrate 10, whereby a linear polarized wave array antenna device for vehicle is configured.

In FIG. 1A, with respect to the plane of the sheet, the leftward direction is referred to as an X-axis direction, and the vertical direction is referred to as a Y-axis direction, and the upward direction is referred to as a Z-axis direction, and the following description will be made.

The array antenna substrate 10 includes a dipole antenna array 30 and two parallel transmission lines 40. the dipole antenna array 30 is formed by forming a first conductor pattern 21 of copper foil or the like on a first surface of a dielectric substrate 20 which is composed of an insulating resin and so on and forming a second conductor pattern 22 of copper foil or the like on a second surface opposing the first surface such that a plurality of dipole antennae 31 is arranged in a straight line in the Z-axis direction on each of the first surface and the second surface.

The two parallel transmission lines 40 are parallel stripe lines which are configured on the first surface of the dielectric substrate 20 and the second surface facing the first surface, respectively, so as to form a pair of conductor patterns having the same line width and having the same shape as seen from one surface. The transmission lines 40 have common transmission line parts 41 which are used in common for feeding power to all dipole antennae 31, and branch transmission line parts 42 which branch from the common transmission line parts 41 (in a T shape) and are used for feeding power to the individual dipole antennae 31, respectively.

The transmission lines 40 are drawn so as not to pass between the dipole antennae 31 constituting the dipole antenna array 30, so it is possible to reduce the influence of the transmission lines 40 on the antenna characteristics of the dipole antenna array 30. The impedance characteristic of the transmission lines 40 can be easily adjusted by changing the width of the conductor patterns, and the transmission lines 40 can be easily connected to components having different impedance (antenna elements, power feed side coaxial lines, and so on). Also, the line lengths and/or widths of the transmission lines can be appropriately changed such that the transmission lines 40 can serve as distributors and/or phase shifters.

However, since the two parallel lines are two parallel transmission lines formed by the substrate conductor and having line widths, in one pair of conductor patterns constituting the transmission lines 40, the widths of the individual lines may not be the same.

As shown in FIG. 1A, to a first conductor pattern 42*a* of a branch transmission line part 42 formed on the first surface of the dielectric substrate 20, a conductor pattern to be a first element 31*a* of the dipole antennae 31 is connected (continuously formed to be connected), and to a second conductor pattern 42*b* of a branch transmission line part 42 formed on the second surface of the dielectric substrate 20, a conductor pattern to be a second element 31*b* of the dipole antennae 31 is connected (continuously formed to be connected). In other words, the dipole antenna array 30 and the transmission lines 40 have a structure which does not use through-holes. The dipole antennae 31 constituting the dipole antenna array 30 are arranged in a straight line in the Z-axis direction, and are excited (fed with power) in the same phase.

The lower side part of the dielectric substrate 20 serves as an insertion installation part 29 to be inserted in the mounting substrate 16 of FIG. 6, and has power feeding parts 40*a* of the transmission lines 40. On both surfaces of the installation part 29, conductor lands 23 are formed, and the conductor lands 23 formed on both sides of the installation part 29 of the dielectric substrate 20 are connected to each other via through-holes 24 in order to increase the peeling strength. In the case of FIG. 6, after the insertion installation part 29 is inserted in a slit hole of the mounting substrate 16, the conductor lands 23 of the installation part 29 are soldered to conductor lands (not shown in the drawings) on the mounting substrate 16 side, such that the dielectric substrate 20, that is, the array antenna substrate 10 is fixed vertically on the mounting substrate 16. The base 15 having the mounting substrate 16 fixed thereon has a mounting part 15*a* for mounting on the roof or the like of the vehicle body of an automobile.

Also, formation of the conductor patterns and the conductor lands on the dielectric substrate 20 can be performed by etching on a substrate with copper foil stuck thereon, printing or coating on the surfaces of a substrate with a conductor, and so on.

Figure 1C:
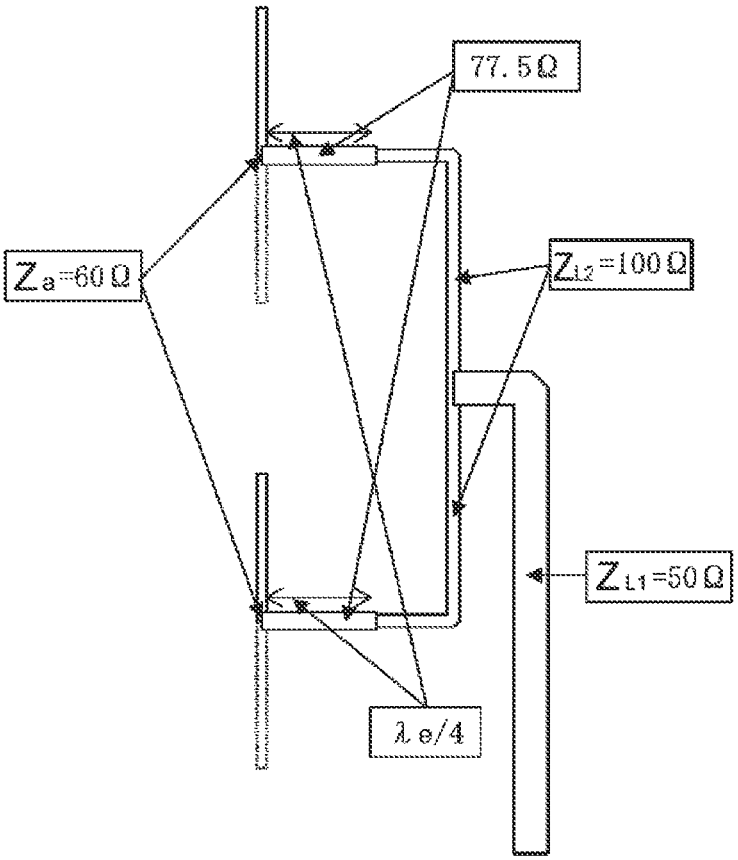
FIG. 1C An explanatory diagram related to impedance matching between a dipole antenna and a transmission line (a power feeding line).

By the way, in order to configure an efficient antenna device, it is important to keep the VSWR low by performing impedance matching between dipole antennae serving as antenna elements and transmission lines (power feeding lines). In FIG. 1C, impedance matching between two dipole antennae and a transmission line on the array antenna substrate having the dipole antenna array and the transmission lines formed on the dielectric substrate will be described. In the array antenna substrate, the impedance characteristic of an "unbranched line" (corresponding to a common transmission line part 41) is referred to as $Z_{L1}$, and the impedance characteristic of a "part of a branch line connected to the unbranched line" (corresponding to a part of a branch transmission line part 42 on the common transmission line part 41 side) is referred to as $Z_{L2}$ and the input impedance of each dipole antenna is referred to as Za.

(1) First, $Z_{L1}$ is determined. In general, $Z_{L1}$ is determined according to the external condition (such as a coaxial line or a circuit) which is connected to the power feeding part of the antenna substrate. It is general to determine 50Ω so as to appropriate for the case of using a coaxial line or the like having impedance characteristic of 50Ω.

(2) Next, in order for impedance matching between the impedance characteristic $Z_{L1}$ of the "unbranched line" and the impedance characteristic $Z_{L2}$ of two "branch lines", $Z_{L2}$ is set by $Z_{L2}=Z_{L1}\times 2$. If $Z_{L1}$ is 50Ω, $Z_{L2}$ becomes 100Ω.

(3) Finally, lines for impedance conversion in which the impedance characteristic of the line is $(Za\times Z_{L2})^{1/2}$ and the length becomes λe/4 (when the equivalent wavelength of radio transmission/reception waves is λe) are connected from the dipole antennae to the "parts of the branch lines connected to the unbranched line". If the input impedance of the dipole antennae is 60Ω (however, it varies according to the shape of the antenna elements), and $Z_{L2}$ is 100Ω, the impedance characteristic of the lines for impedance conversion becomes 77.5Ω.

Also, in the case where the impedance levels of the two dipole antennae are different due to the external condition (the base and the case of the antenna device, the roof of the vehicle body, and so on) under which the antenna substrate is installed, Za is appropriately replaced with different values such as $Za_1$, $Za_2$, and the like, and in view of each of the different values, the characteristics of the lines for impedance conversion are set.

The first embodiment of FIGS. 1A and 1B uses stepwise impedance conversion and the like on the basis of the impedance matching method of FIG. 1C.

In the first embodiment, in the case of feeding power to the power feeding parts 40*a* of the two parallel transmission lines 40 via balanced lines, the two parallel transmission lines 40 perform a balanced power feeding operation to excite the dipole antennae 31. Meanwhile, in the case where power feeding to the power feeding part 40*a* of the two parallel transmission lines 40 via unbalanced lines is performed, the impedance characteristic of the two parallel lines of the common transmission line parts 41 which are unbranched transmission line parts is set to be small (in the present embodiment, the impedance characteristic of the two parallel lines is set to 50Ω) such that even though power feeding via unbalanced lines is performed, in the two parallel lines, a balanced operation becomes dominant. As a result, with respect to the power feeding parts 40*a*, power feeding via balanced lines and power feeding via unbalanced lines become possible.

Also, the reason why even though power feeding via unbalanced lines is performed, in the two parallel transmission lines 40, the balanced operation becomes dominant will be described below in brief. In the case where the whole of the array antenna substrate 10 which is installed vertically on a ground plate and is fed with power via unbalanced lines is virtually considered as a monopole antenna which is configured by forming conductor patterns on the dielectric substrate 20, the impedance characteristic (referred to as $Z_0$) which the power feeding parts 40*a* which are power feeding points can have becomes several hundreds Ω. Here, if the impedance characteristic of the two parallel transmission lines 40 is set to a value (for example, 50Ω or the like) sufficiently smaller than impedance characteristic $Z_0$ and close to the output impedance (for example, 50Ω) of circuits and transmission lines which are connected to the antenna device, the power which is propagated in the two parallel transmission lines 40 having small impedance increases (the power for a monopole antenna operation extremely decreases), and its characteristic becomes dominant, and power feeding via unbalanced lines becomes possible.

In the case of operating the above-described antenna device for vehicle, for example, as a transmitting antenna, a high-frequency signal fed to the power feeding part 40*a* of the transmission lines 40 positioned at the lower edge part of the dielectric substrate 20 is distributed by the common transmission line parts 41 of the transmission lines 40 and the branch transmission line parts 42 branching from them, and propagates, and is fed to the individual dipole antennae 31, and is radiated to a space.

Figure 1D:
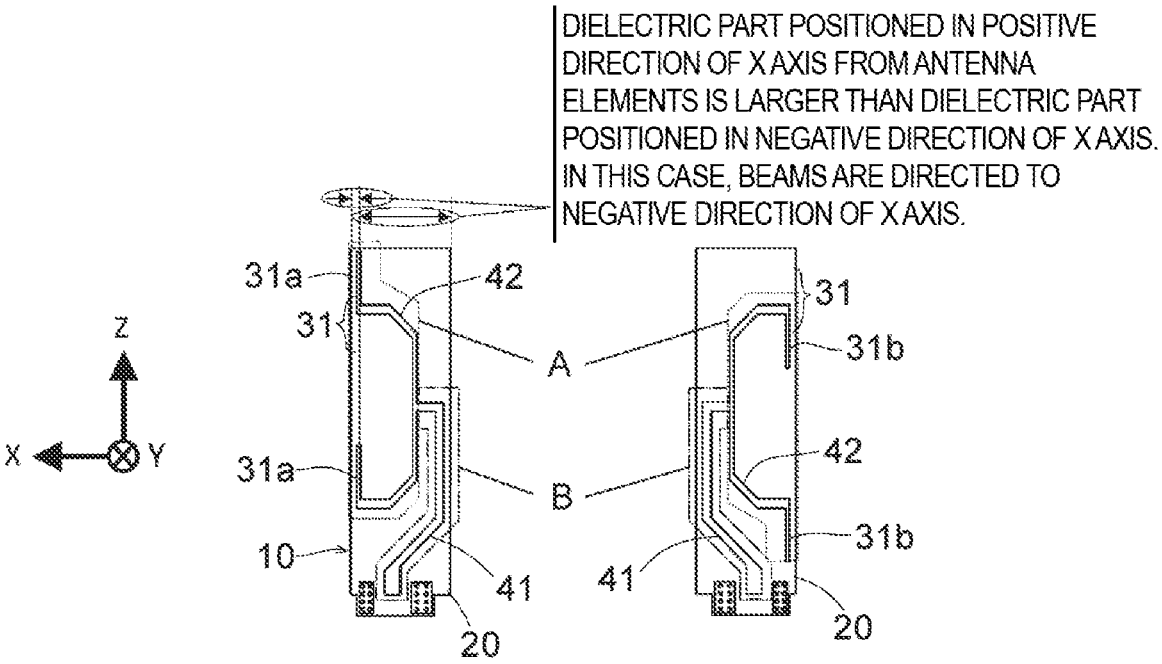
FIG. 1D An explanatory diagram for explaining the operation of the first embodiment.

With reference to FIG. 1D, details of the operation of the antenna device for vehicle will be described. In this regard, on the left side of FIG. 1D, the first surface of the array antenna substrate 10 is shown, and on the right side, the second surface is shown. In the left view showing the first surface, with respect to the plane of the sheet, the leftward direction is referred to as the X-axis direction, and the vertical direction is referred to as the Y-axis direction, and the upward direction is referred to as the Z-axis direction, and the following description will be made.

It is known that in the case of the vertical dipole antennae 31 disposed in free space, the directivity in horizontal plane of vertical polarized wave is omni-directivity (there is no change in gain in all directions). However, in the case of forming the dipole antennae 31 and the transmission lines 40 on the dielectric substrate 20 like the first embodiment, the antenna device is influenced as follows.

(1) When the length of Parts A of FIG. 1D (which are the parts surrounded by dotted lines, and correspond to the parts of the first conductor pattern 21 and the second conductor pattern 22 other than the conductor patterns forming the common transmission line parts 41) is within a range smaller than 5λ/2, for example, it is about 3λ/2, deviation in the gain in X-Y plane of vertical polarized wave decreases. In the case where the length of Parts A is smaller or larger than about 3λ/2, the dipole antennae have directivity in which in the gain in X-Y plane of vertical polarized wave, the gain in the positive direction of the X axis becomes large and the gain in the negative direction becomes small (wherein λ is the free space wavelength of radio transmission or reception waves). Also, the above-described result was obtained empirically. Also, a range in which the length of Parts A is larger than 5λ/2 lacks practicality because the area of the dielectric substrate 20 becomes larger than demand.

(2) When it is assumed that the transmission lines 40 do not exist, the dipole antennae 31 have directivity in which with reference to the position of the dipole antennae 31 on the X axis, in the direction on the X axis in which the dielectric of the dielectric substrate 20 is long, the gain in X-Y plane of vertical polarized wave becomes large, and in the direction on the X axis in which the dielectric is short, the gain becomes small. This is based on the radio-wave convergence effect attributable to the permittivity of the dielectric substrate 20 higher than that of air.

(3) If the transmission lines of Parts B (which are the parts surrounded by dot-and-dash lines and correspond to the common transmission line parts 41) are configured by bending them to the negative direction of the Z axis at points apart from the branch points such that components parallel with the dipole antennae 31 occur, the transmission lines of Parts B (the common transmission line parts 41) act as reflectors. If the unbranched line parts (the common transmission line parts 41) are moved in parallel in the negative direction of the X axis, and for connection with the divided branch points, straight lines having the same width as that of the unbranched lines (the common transmission line parts 41) are added, deviation in the gain in X-axis direction of vertical polarized wave in X-Y plane decreases.

In the first embodiment of FIGS. 1A and 1B, according to the item (1), it is possible to obtain the characteristic close to omni-directivity. According to the item (2), it is possible to obtain the effect that the gain in the negative direction of the X axis becomes large. According to the item (3), it is possible to obtain the effect that the gain in the positive direction of the X axis becomes large. The effects obtained according to the items (1) to (3) are integrated, whereby the deviation in the gain in X-Y plane of vertical polarized wave is small, that is, the characteristic close to omni-directivity is obtained.

As shown in FIG. 2 to FIG. 5, the VSWR and the gain in horizontal plane of vertical polarized wave are obtained by a simulation in the case where the array antenna substrate 10 is installed vertically on a circular ground plate having a diameter of 1 m (a circular conductor plate having a diameter of 1 m), and an X-axis direction, a Y-axis direction, and a Z-axis direction are defined similarly to the X-axis direction, the Y-axis direction, and the Z-axis direction defined in FIG. 1A. Also, it can be considered that the circular ground plate having the diameter of 1 m is equivalently the roof of a vehicle body. When the equivalent wavelength of radio transmission/reception waves (here, the 5.9 GHz band for DSRC communication) is λe, each dipole antenna 31 is set to a length of λe/2.

Figure 2:
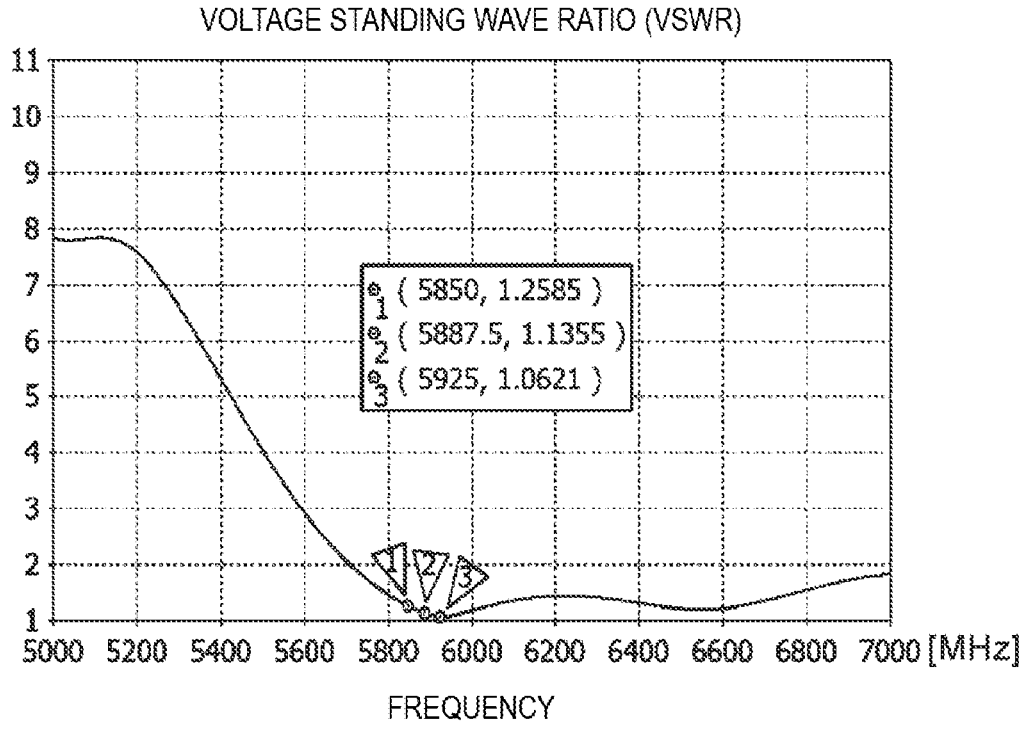
FIG. 2 A graph illustrating a VSWR-frequency characteristic in the case of the first embodiment.
Figure 3:
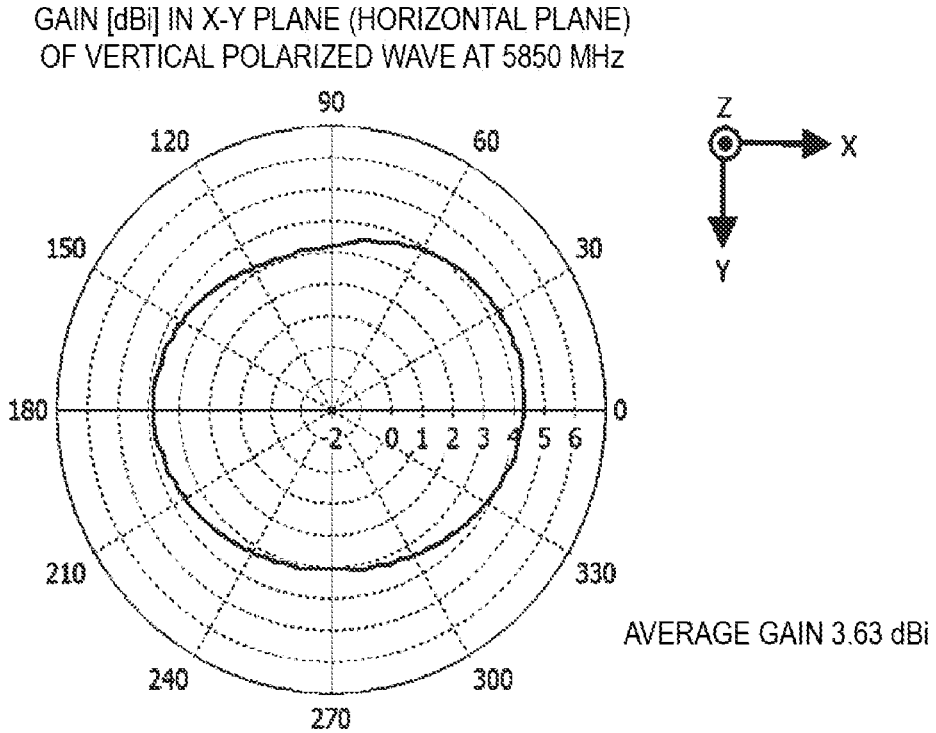
FIG. 3 A graph illustrating the gain in horizontal plane of vertical polarized wave at 5850 MHz in the case of the first embodiment.
Figure 4:
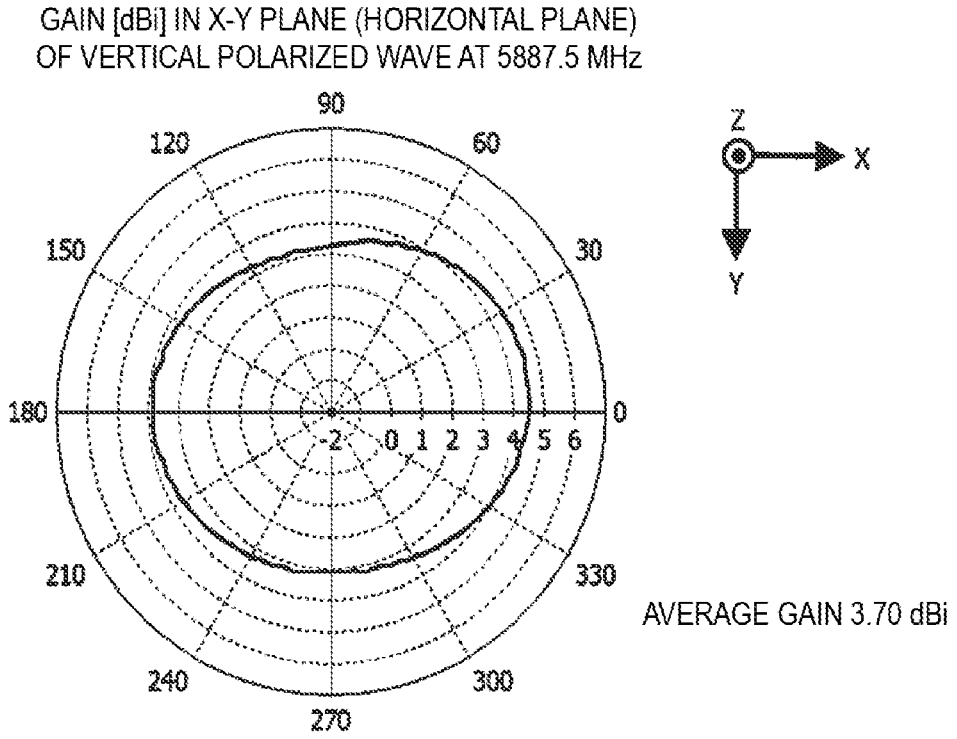
FIG. 4 A graph similarly illustrating the gain in horizontal plane of vertical polarized wave at 5887.5 MHz.
Figure 5:
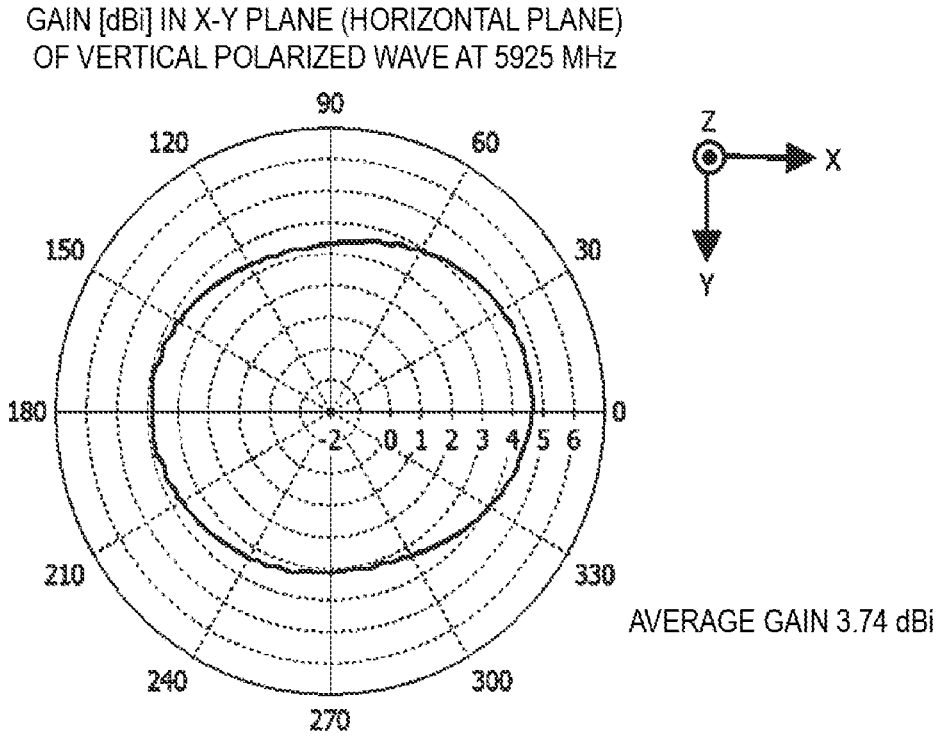
FIG. 5 A graph similarly illustrating the gain in horizontal plane of vertical polarized wave at 5925 MHz.

As shown in FIG. 2, the VSWR in the case of FIG. 1A and FIG. 1B is 1.2585 at 5850 MHz, and is 1.1355 at 5887.5 MHz, and is 1.0621 at 5925 MHz. Also, the gain in horizontal plane of vertical polarized wave at 5850 MHz is shown in FIG. 3, and the average gain is 3.63 dBi. The gain in horizontal plane of vertical polarized wave at 5887.5 MHz is shown in FIG. 4, and the average gain is 3.70 dBi, and the gain in horizontal plane of vertical polarized wave at 5925 MHz is shown in FIG. 5, and the average gain is 3.74 dBi.

According to the present embodiment, it is possible to achieve the following effects.

(1) The array antenna substrate 10 has the configuration having the dipole antenna array 30 and the transmission lines 40 formed by the conductor patterns on the dielectric substrate 20, and can increase the gain in horizontal plane of vertical polarized wave. Also, directivity in horizontal plane has the characteristic in which the deviation in gain is small and which is close to omni-directivity.

(2) Since the antenna is configured with the substrate, it is possible to reduce the amount of material and the manufacturing cost as compared to the case of using a coaxial structure, a sleeve structure, or the like.

(3) It is possible to reduce the structural tolerances of the dielectric substrate 20, and the first conductor pattern 21 and the second conductor pattern 22 which are formed on the dielectric substrate, and it is possible to stabilize the characteristic.

(4) Since the transmission lines 40 having the widths, and it is possible to easily adjust the impedance by changing the widths, it is possible to easily perform impedance conversion necessary for distribution. Therefore, it is possible to easily implement the distribution function, and it becomes possible to form the array of the dipole antennae 31 (to increase the gain) without adding special components.

(5) Since the transmission lines 40 having the widths are used, it is possible to easily perform impedance conversion (connection with different load impedance). For the power feeding parts 40*a* of the transmission lines 40, both of unbalanced power feeding and balanced power feeding are possible, and it is also possible to feed power via a coaxial cable without separately providing a matching circuit.

(6) The array antenna substrate 10 has a planer structure, and can be easily mounted on a shark-fin shape antenna and so on. For example, in FIG. 6, although not shown in the drawings, a GPS antenna, an XM antenna, an AM/FM antenna, and so on may be accommodated in the case 17 having the shark-fin shape. Alternatively, in FIG. 6, the array antenna substrate 10 may be disposed at the center or front part of the case 17.

(7) Since the two parallel transmission lines 40 have the structure in which the pair of conductor patterns face each other across the dielectric substrate 20 interposed between the pair of the conductor patterns, they needs a small area on the dielectric substrate 20. Therefore, it is possible to reduce the size of the dielectric substrate 20.

(8) The dipole antenna array 30 and the transmission lines 40 have structures having no through-holes. For this reason, the manufacturing is easy, and the cost is low.

Figure 7A:
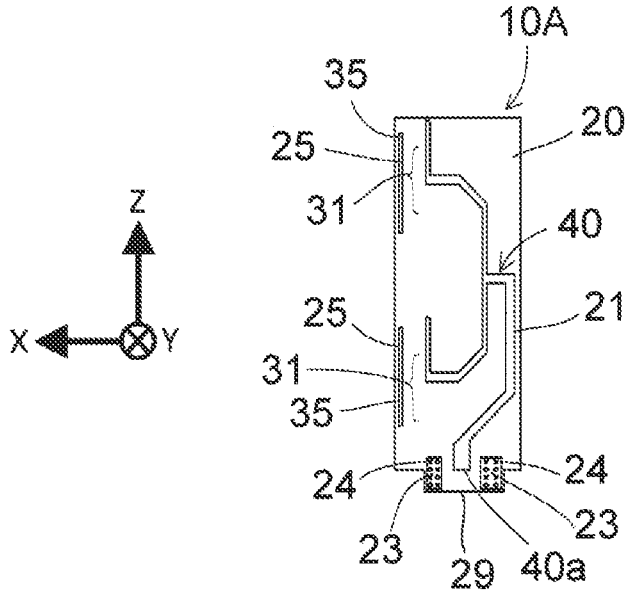
FIG. 7A A diagram illustrating a first surface of an array antenna substrate according to a second embodiment in the case of configuring a linear polarized wave array antenna device for vehicle as an antenna device for vehicle according to the present invention.
Figure 7B:
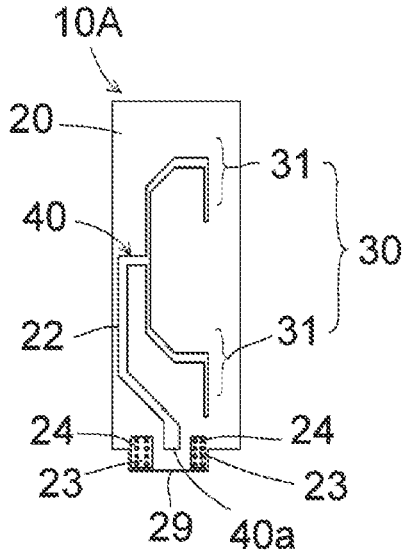
FIG. 7B A diagram illustrating a second surface of the army antenna substrate according to the second embodiment.

FIG. 7A and FIG. 7B show an array antenna substrate 10A according to a second embodiment in the case of configuring a linear polarized wave array antenna device for vehicle as an antenna device for vehicle according to the present invention. A difference between the array antenna substrate 10A and the array antenna substrate 10 shown in the first embodiment is that the array antenna substrate 10A has wave directors 35 formed by a conductor pattern 25 in parallel with the individual dipole antennae 31 on the first surface of the dielectric substrate 20. The other configuration is similar to that of the first embodiment.

Also, in FIG. 7A, with respect to the plane of the sheet, the leftward direction is referred to as an X-axis direction, and the vertical direction is referred to as a Y-axis direction, and the upward direction is referred to as a Z-axis direction, and the following description will be made.

The wave directors 35 are slightly shorter than the dipole antennae 31 ($\lambda e/2$) when the equivalent wavelength is $\lambda e$, and are disposed apart from the dipole antennae 31 by about $\lambda/4$. As a result, on the side where the wave directors 35 are disposed, directivity occurs.

As shown in FIG. 8 to FIG. 11, the VSWR and the gain in horizontal plane of vertical polarized wave are obtained by a simulation in the case where the array antenna substrate 10A is installed vertically on a circular ground plate having a diameter of 1 m, and an X-axis direction, a Y-axis direction, and a Z-axis direction are defined similarly to the X-axis direction, the Y-axis direction, and the Z-axis direction defined in FIG. 7A.

Figure 8:
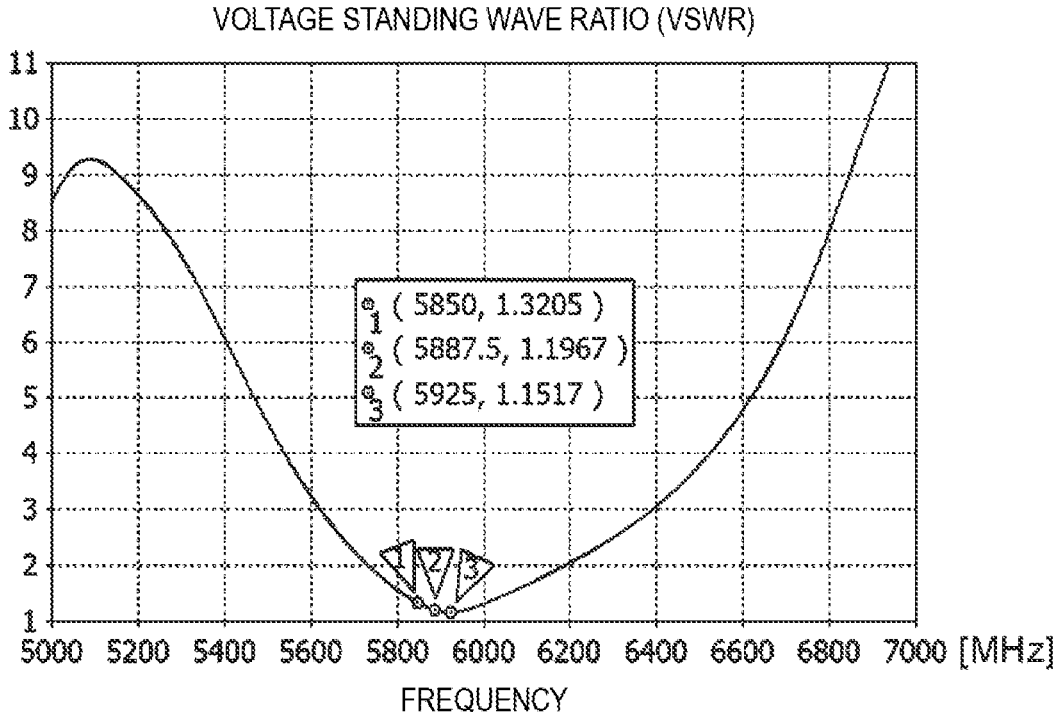
FIG. 8 A graph illustrating a VSWR-frequency characteristic according to frequency in the case of the second embodiment.
Figure 9:
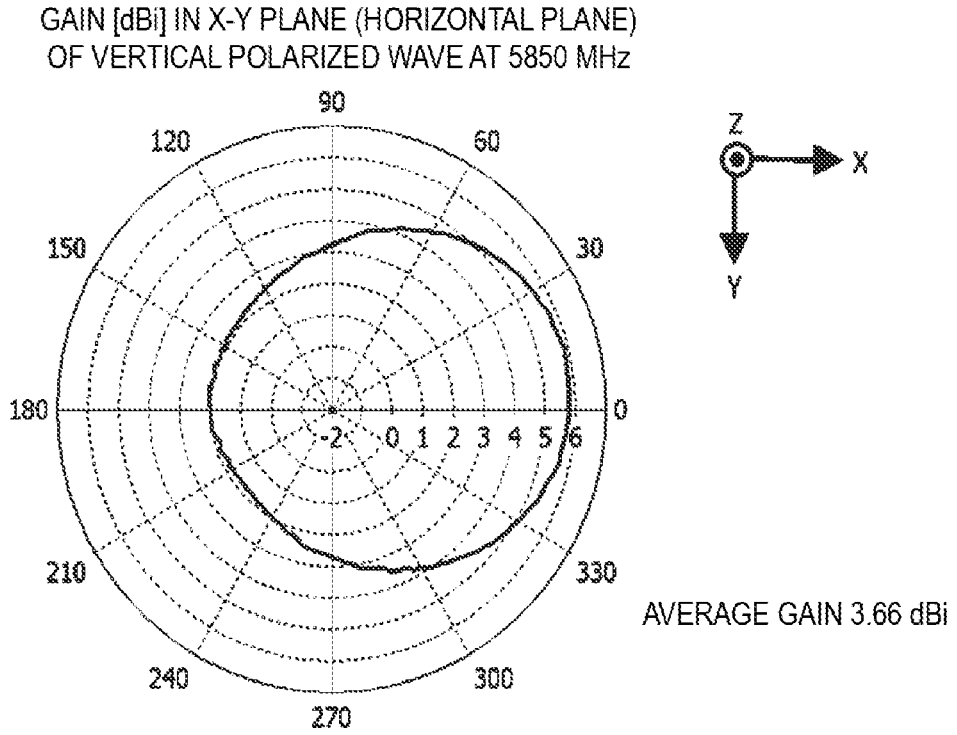
FIG. 9 A graph illustrating the gain in horizontal plane of vertical polarized wave at 5850 MHz in the case of the second embodiment.
Figure 10:
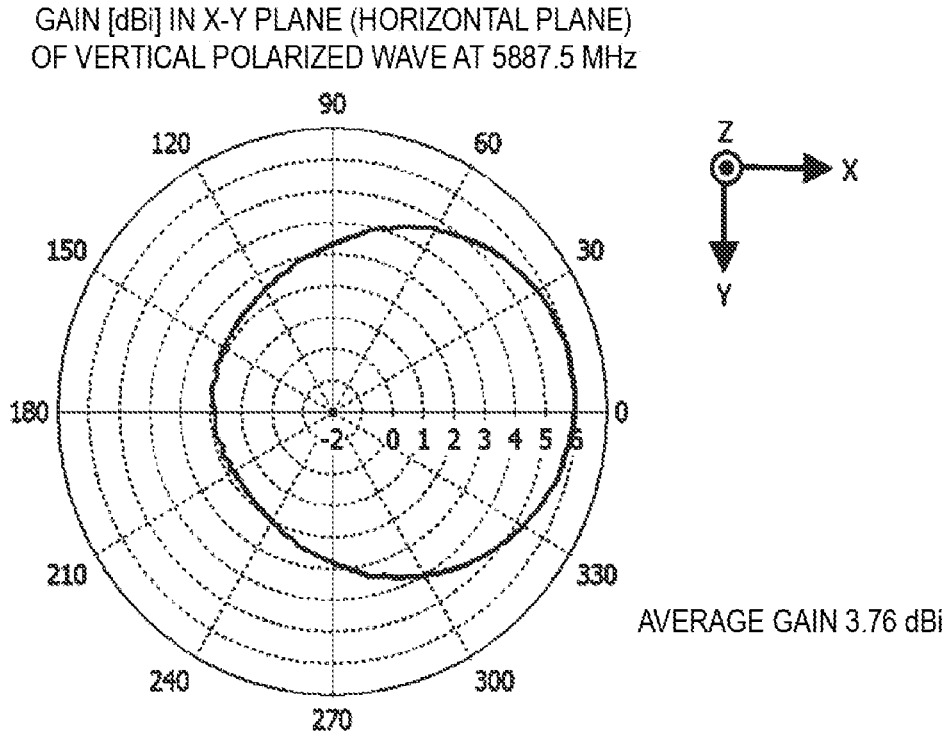
FIG. 10 A graph similarly illustrating the gain in horizontal plane of vertical polarized wave at 5887.5 MHz.
Figure 11:
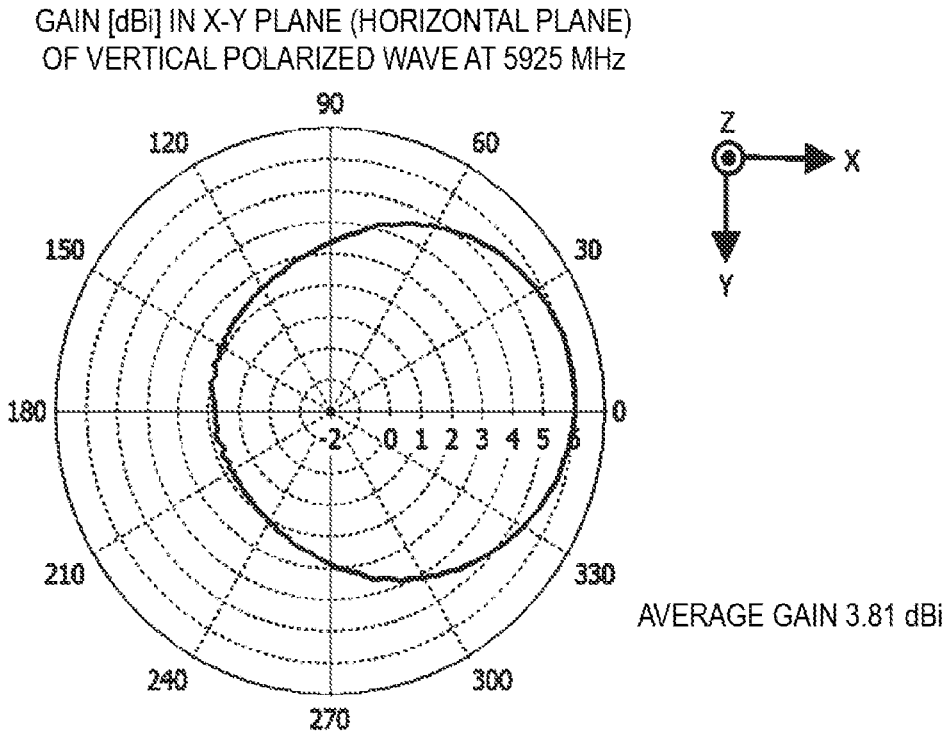
FIG. 11 A graph similarly illustrating the gain in horizontal plane of vertical polarized wave at 5925 MHz.

As shown in FIG. 8, the VSWR in the case of FIG. 7A and FIG. 7B is 1.3205 at 5850 MHz, and is 1.1967 at 5887.5 MHz, and is 1.1517 at 5925 MHz. Also, the gain in horizontal plane of vertical polarized wave at 5850 MHz is shown in FIG. 9, and the average gain is 3.66 dBi. The gain in horizontal plane of vertical polarized wave at 5887.5 MHz is shown in FIG. 10, and the average gain is 3.76 dBi, and the gain in horizontal plane of vertical polarized wave at 5925 MHz is shown in FIG. 11, and the average gain is 3.81 dBi.

According to the second embodiment, since the wave directors 35 are disposed in parallel with the individual dipole antennae 31, respectively, it is possible to cause directivity on the side where the wave directors 35 are disposed, thereby increasing the gain in the directivity direction. For example, if the array antenna substrate 10A is mounted on the base 15 of FIG. 6 such that the wave directors 35 are positioned on the front side, it has directivity in which high gain is obtained in the traveling direction of the automobile.

In the second embodiment, the configuration in which the wave directors 35 are provided on the first surface has been described; however, wave directors 35 may be provided on the second surface, or wave directors 35 may be provided on both of the first surface and the second surface.

Figure 12A:
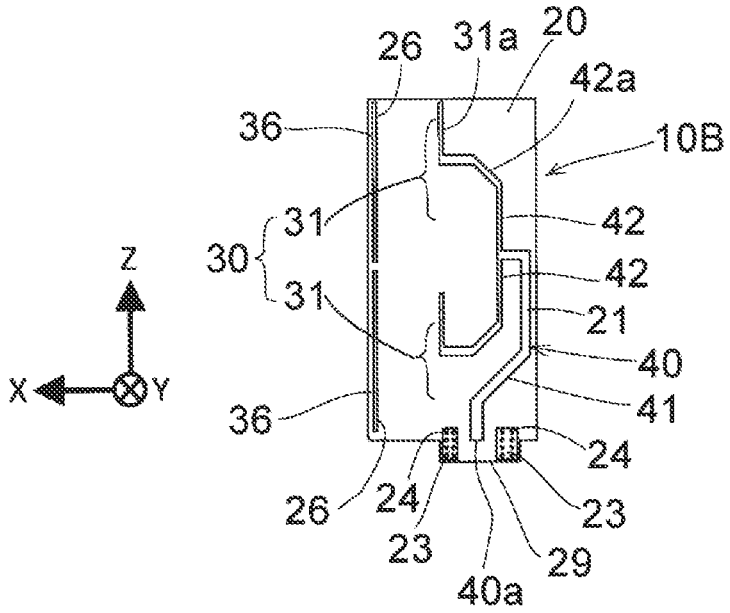
FIG. 12A A diagram illustrating a first surface of an array antenna substrate according to a third embodiment in the case of configuring a linear polarized wave array antenna device for vehicle as an antenna device for vehicle according to the present invention.
Figure 12B:
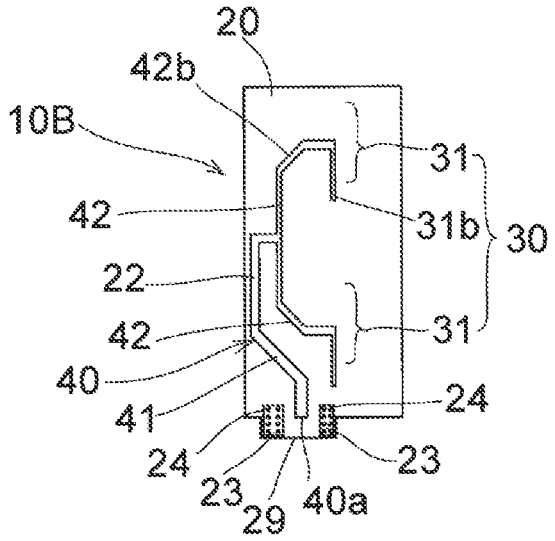
FIG. 12B A diagram illustrating a second surface of the array antenna substrate according to the third embodiment.

FIG. 12A and FIG. 12B show an array antenna substrate 10B according to a third embodiment in the case of configuring a linear polarized wave array antenna device for vehicle as an antenna device for vehicle according to the present invention. A difference between this array antenna substrate 10B and the array antenna substrate 10 shown in the first embodiment is that the array antenna substrate 10B has reflectors 36 formed by a conductor pattern 26 in parallel with the individual dipole antennae 31 on the first surface of the dielectric substrate 20. The other configuration is similar to that of the first embodiment.

Also, in FIG. 12A, with respect to the plane of the sheet, the leftward direction is referred to as an X-axis direction, and the vertical direction is referred to as a Y-axis direction, and the upward direction is referred to as a Z-axis direction, and the following description will be made.

The reflectors 36 are slightly longer than the dipole antennae 31 ($\lambda e/2$) when the equivalent wavelength is $\lambda e$, and are disposed apart from the dipole antennae 31 by about $\lambda/4$. As a result, on the opposite side to the side where the reflectors 36 are disposed, directivity occurs.

As shown in FIG. 13 to FIG. 16, the VSWR and the gain in horizontal plane of vertical polarized wave are obtained by a simulation in the case where the array antenna substrate 10B is installed vertically on a circular ground plate having a diameter of 1 m, and an X-axis direction, a Y-axis direction, and a Z-axis direction are defined similarly to the X-axis direction, the Y-axis direction, and the Z-axis direction defined in FIG. 12A.

Figure 13:
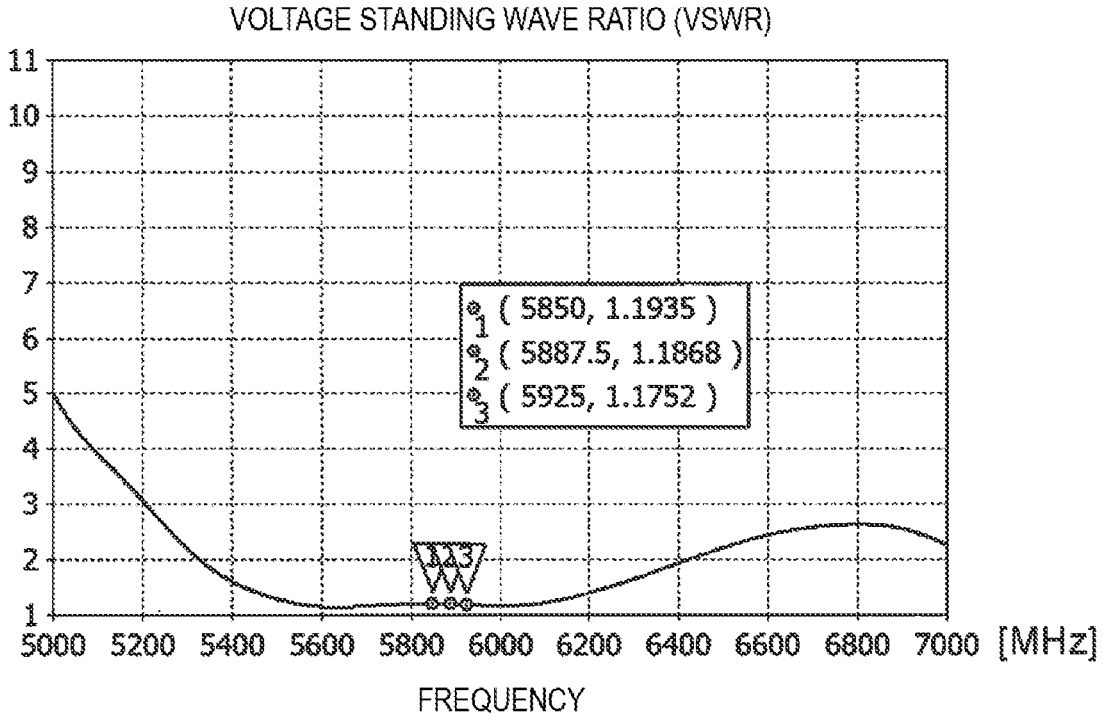
FIG. 13 A graph illustrating a VSWR-frequency characteristic in the case of the third embodiment.
Figure 14:
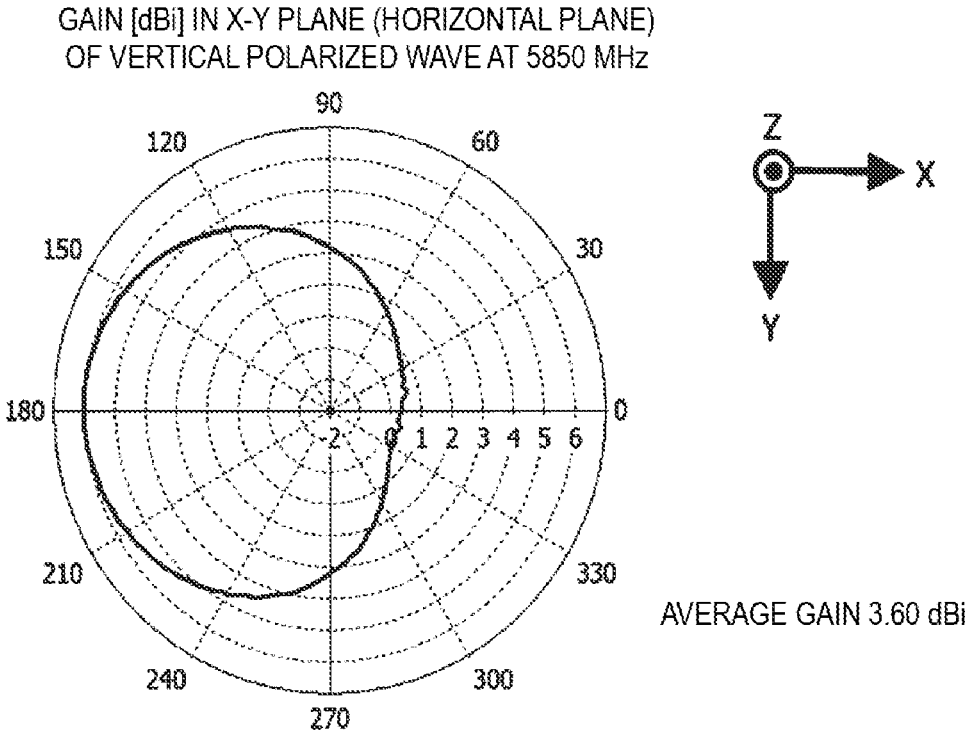
FIG. 14 A graph illustrating the gain in horizontal plane of vertical polarized wave at 5850 MHz in the case of the third embodiment.
Figure 15:
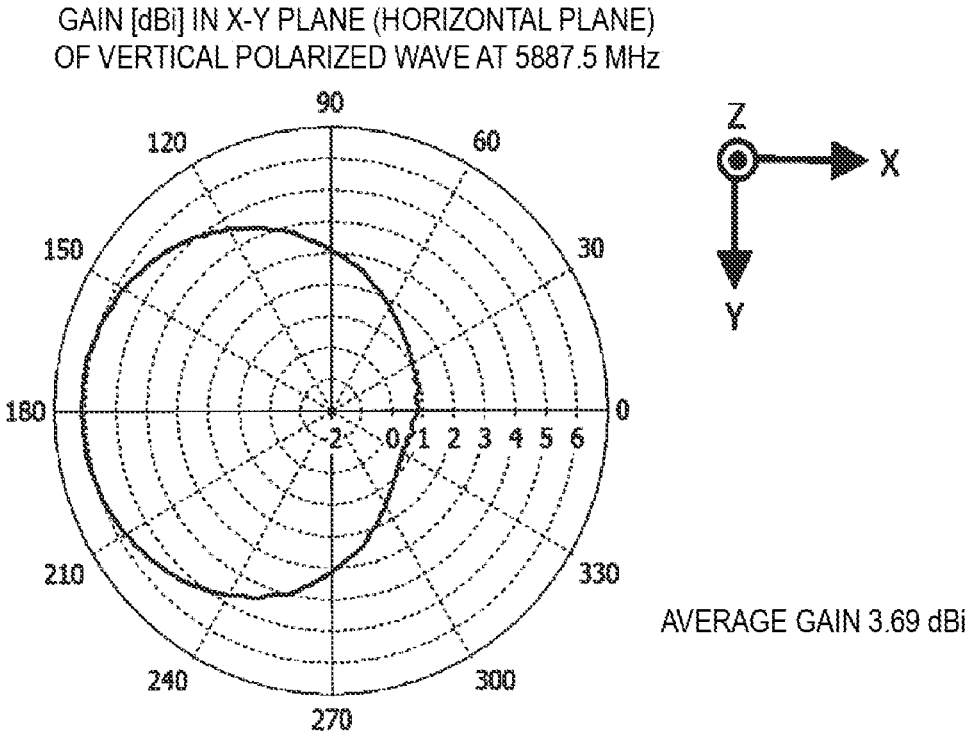
FIG. 15 A graph similarly illustrating the gain in horizontal plane of vertical polarized wave at 5887.5 MHz.
Figure 16:
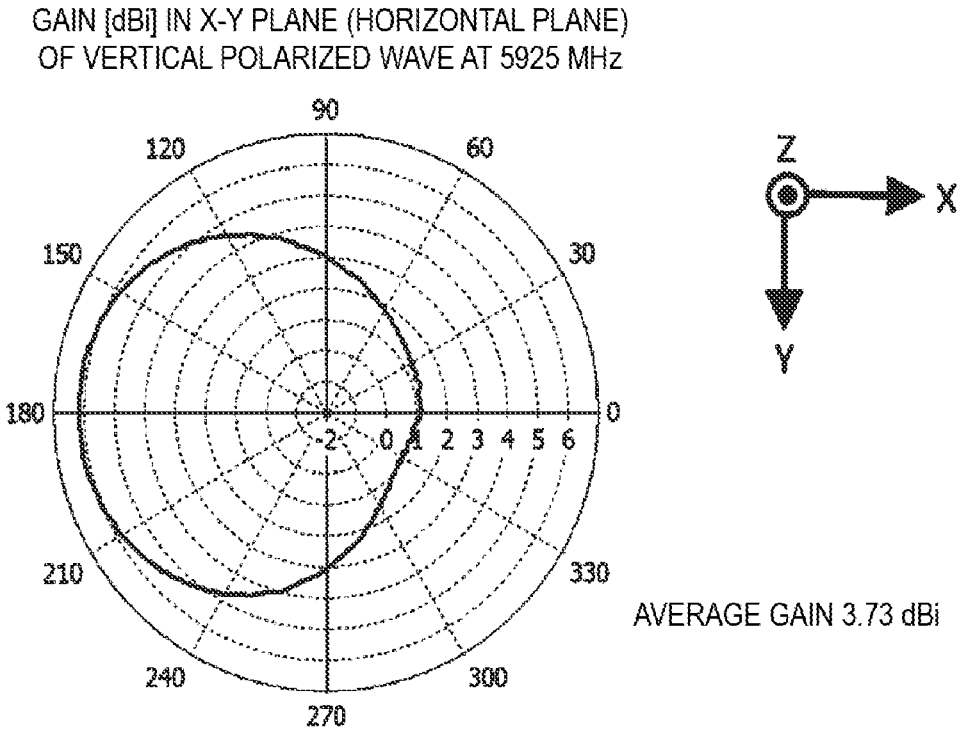
FIG. 16 A graph similarly illustrating the gain in horizontal plane of vertical polarized wave at 5925 MHz.

As shown in FIG. 13, the VSWR in the case of FIG. 12A and FIG. 12B is 1.1935 at 5850 MHz, and is 1.1868 at 5887.5 MHz, and is 1.1752 at 5925 MHz. Also, the gain in horizontal plane of vertical polarized wave at 5850 MHz is shown in FIG. 14, and the average gain is 3.60 dBi. The gain in horizontal plane of vertical polarized wave at 5887.5 MHz is shown in FIG. 15, and the average gain is 3.69 dBi, and the gain in horizontal plane of vertical polarized wave at 5925 MHz is shown in FIG. 16, and the average gain is 3.73 dBi.

According to the third embodiment, since the reflectors 36 are disposed in parallel with the individual dipole antennae 31, respectively, it is possible to cause directivity on the opposite side to the side where the reflectors 36 are disposed, thereby increasing the gain in the directivity direction. For example, if the array antenna substrate 10A is mounted on the base 15 of FIG. 6 such that the reflectors 36 are positioned on the front side, it has directivity in which high gain is obtained on the opposite side to the traveling direction of the automobile.

In the third embodiment, the configuration in which the reflectors 36 are provided on the first surface has been described; however, reflectors 36 may be provided on the second surface, or reflectors 36 may be provided on both of the first surface and the second surface.

Figure 17A:
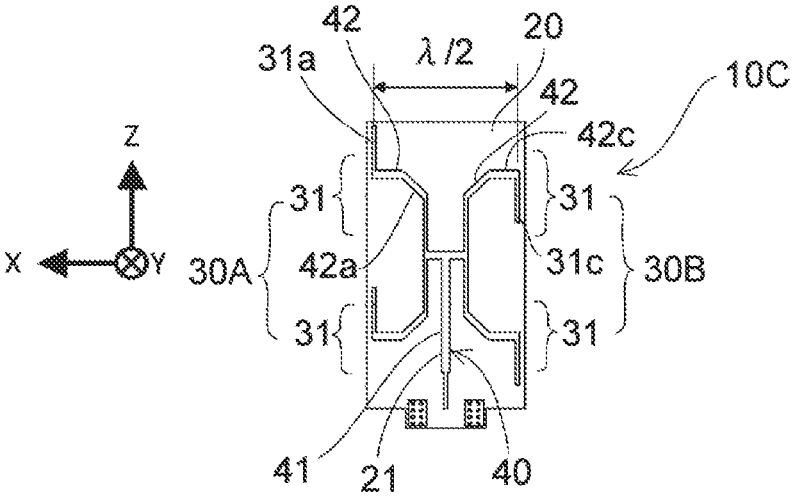
FIG. 17A A diagram illustrating a first surface of an array antenna substrate according to a fourth embodiment in the case of configuring a linear polarized wave array antenna device for vehicle as an antenna device for vehicle according to the present invention.
Figure 17B:
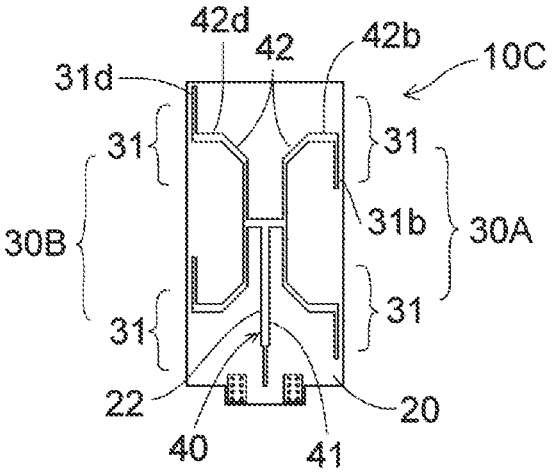
FIG. 17B A diagram illustrating a second surface of the array antenna substrate according to the fourth embodiment.

FIG. 17A and FIG. 17B show an array antenna substrate 10C according to a fourth embodiment in the case of configuring a linear polarized wave array antenna device for vehicle as an antenna device for vehicle according to the present invention. A difference between this array antenna substrate 10C and the array antenna substrate 10 shown in the first embodiment is that the array antenna substrate 10C has a pair of dipole antenna arrays 30A and 30B in the left-right direction (width direction) of the dielectric substrate 20. The other configuration is similar to that of the first embodiment.

Also, in FIG. 17A, with respect to the plane of the sheet, the leftward direction is referred to as an X-axis direction, and the vertical direction is referred to as a Y-axis direction, and the upward direction is referred to as a Z-axis direction, and the following description will be made.

One dipole antenna array 30A is identical to the dipole antenna array 30 of the first embodiment, and conductor patterns forming upward first elements 31*a* of the dipole antennae 31 are connected to (formed to be connected to) the first conductor patterns 42*a* of the branch transmission line parts 42 provided on the first surface of the dielectric substrate 20, and conductor patterns forming downward second elements 31*b* of the dipole antennae 31 are connected to (formed to be connected to) the second conductor patterns 42*b* of the branch transmission line parts 42 provided on the second surface of the dielectric substrate 20.

The other dipole antenna array 30B is configured so as to be excited (fed with power) in the opposite phase to that of the dipole antenna array 30A. In other words, conductor patterns forming downward third elements 31*c* of the dipole antennae 31 are connected to (continuously formed to be connected to) third conductor patterns 42*c* of the branch transmission line parts 42 provided on the first surface of the dielectric substrate 20, and conductor patterns forming upward fourth elements 31*d* are connected to (continuously formed to be connected to) fourth conductor patterns 42*d* of the branch transmission line parts 42 provided on the second surface of the dielectric substrate 20. Even in this case, the dipole antenna arrays 30A and 30B and the transmission lines 40 have structures using no through-holes.

The dipole antenna array 30A which is formed on the left side of the dielectric substrate 20 and the dipole antenna array 30B which is formed on the right side are disposed to be parallel with each other and be apart from each other by about λ/2.

As shown in FIG. 18 to FIG. 21, the VSWR and the gain in horizontal plane of vertical polarized wave are obtained by a simulation in the case where the array antenna substrate 10C is installed vertically on a circular ground plate having a diameter of 1 m, and an X-axis direction, a Y-axis direction, and a Z-axis direction are defined similarly to the X-axis direction, the Y-axis direction, and the Z-axis direction defined in FIG. 17.

Figure 18:
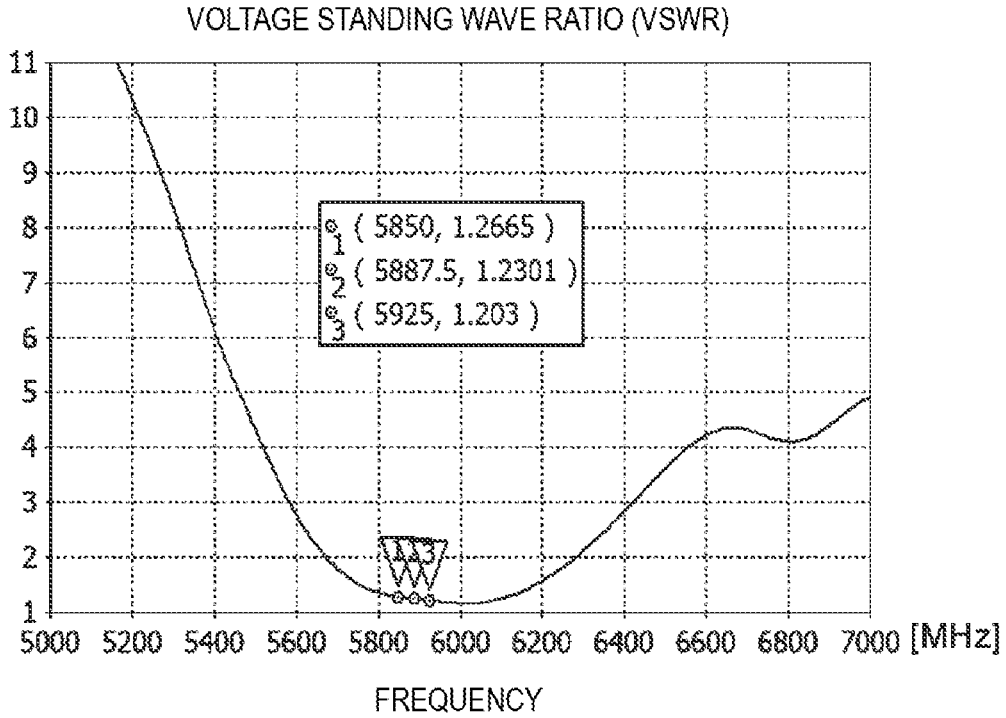
FIG. 18 A graph illustrating a VSWR-frequency characteristic in the case of the fourth embodiment.
Figure 19:
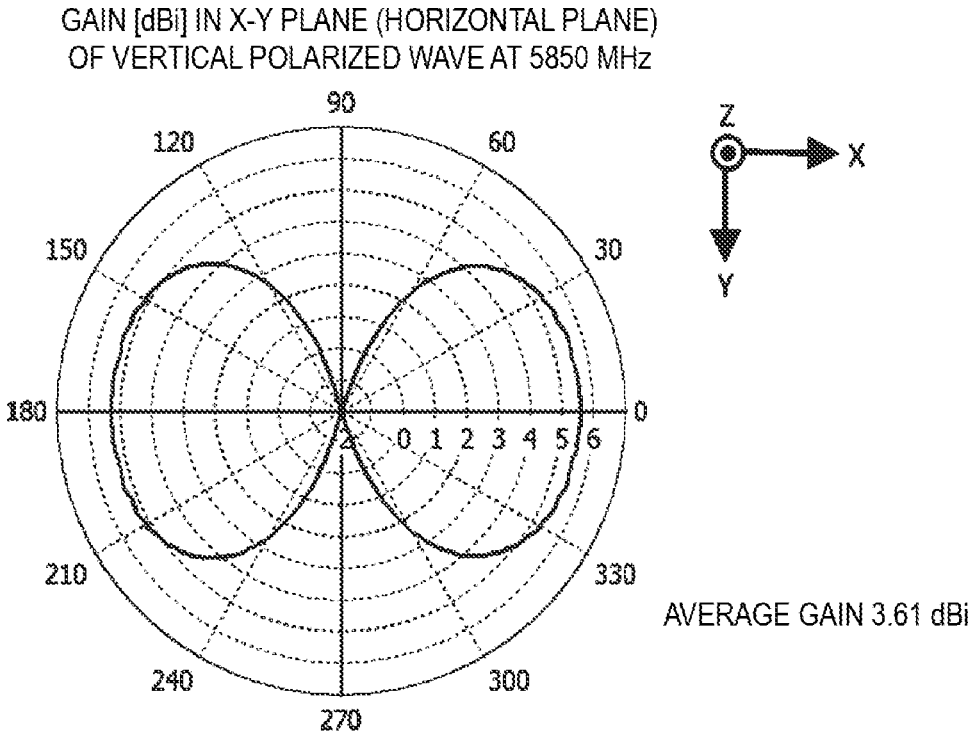
FIG. 19 A graph illustrating the gain in horizontal plane of vertical polarized wave at 5850 MHz in the case of the fourth embodiment.
Figure 20:
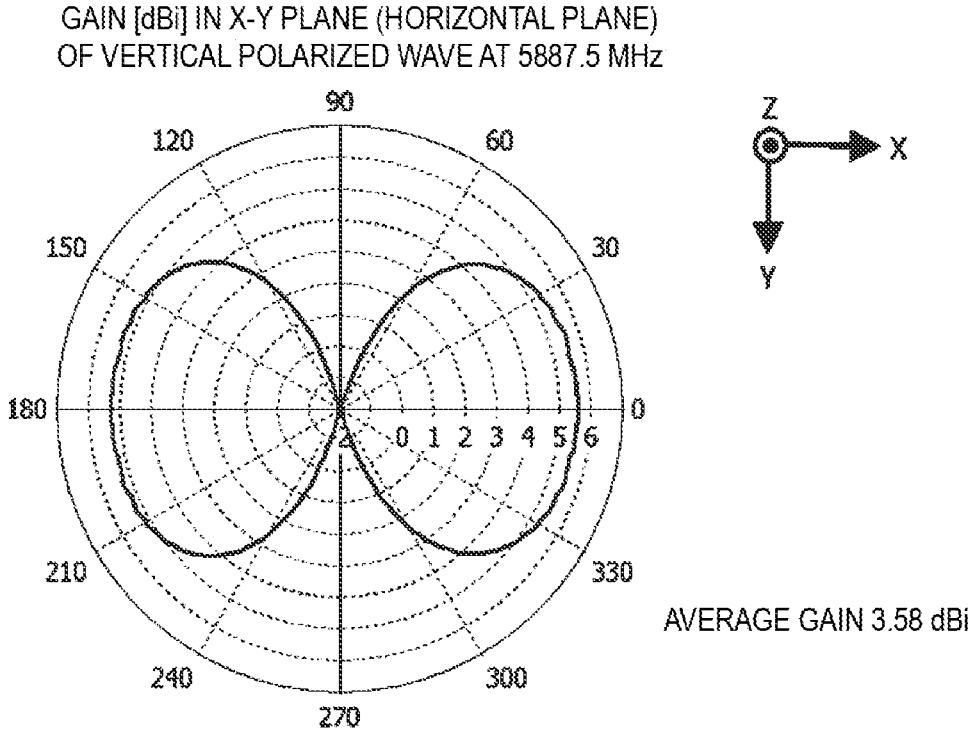
FIG. 20 A graph similarly illustrating the gain in horizontal plane of vertical polarized wave at 5887.5 MHz.
Figure 21:
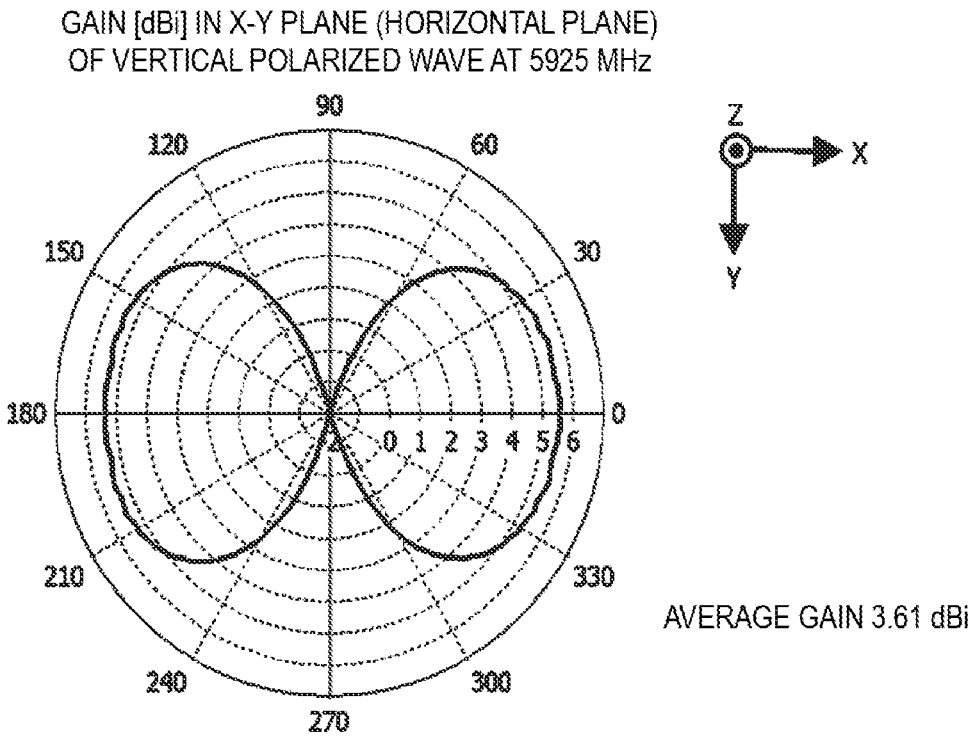
FIG. 21 A graph similarly illustrating the gain in horizontal plane of vertical polarized wave at 5925 MHz.
Figure 22:
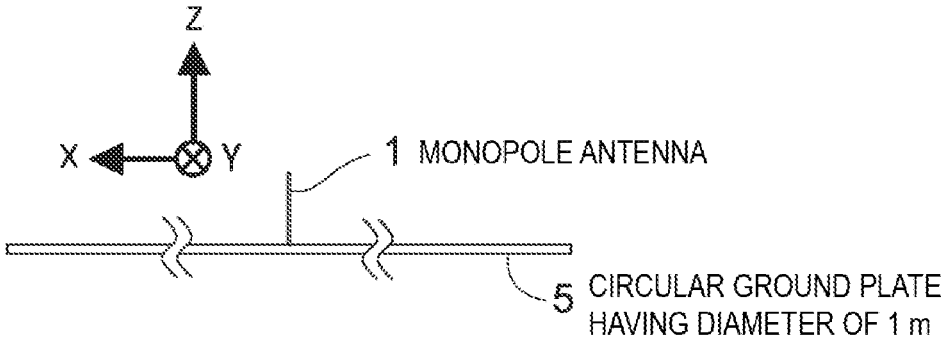
FIG. 22 A diagram illustrating a first conventional example in a state where a monopole antenna is mounted on a circular ground plate having a diameter of 1 m.
Figure 23:
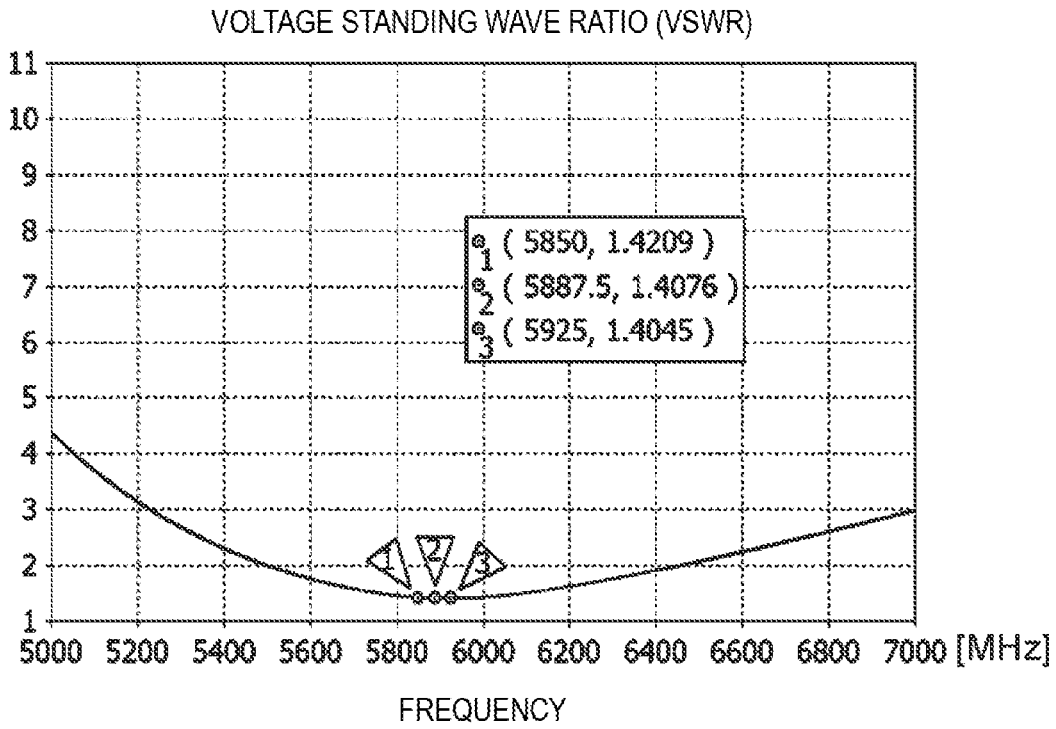
FIG. 23 A graph illustrating a VSWR-frequency characteristic in the case of the first conventional example.
Figure 24:
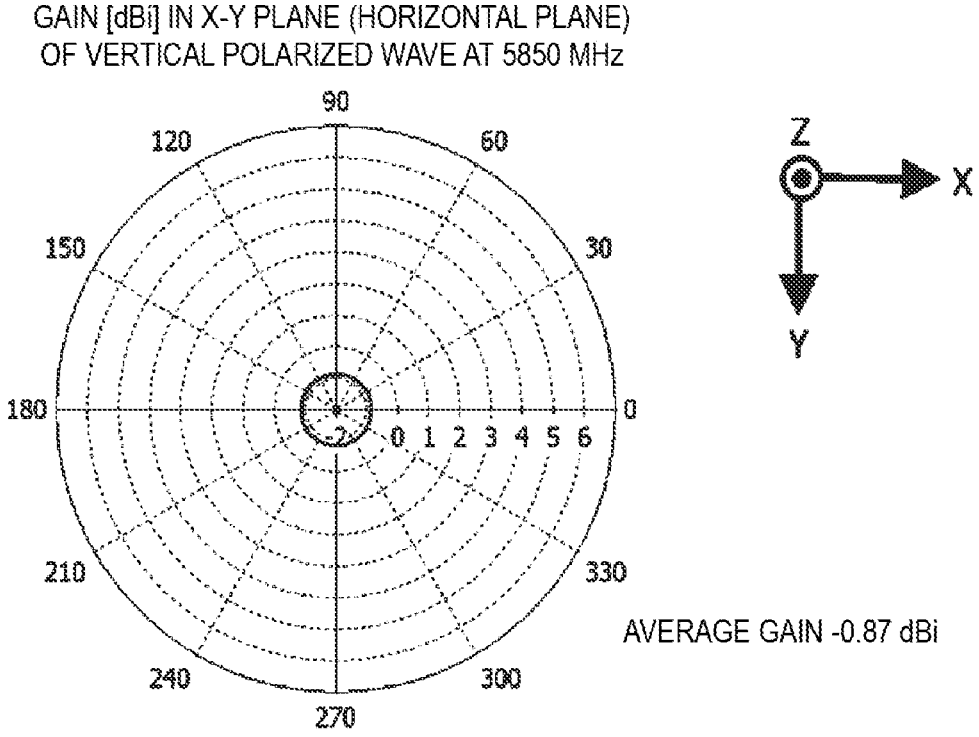
FIG. 24 A graph illustrating the gain in horizontal plane of vertical polarized wave at 5850 MHz in the case of the first conventional example.
Figure 25:
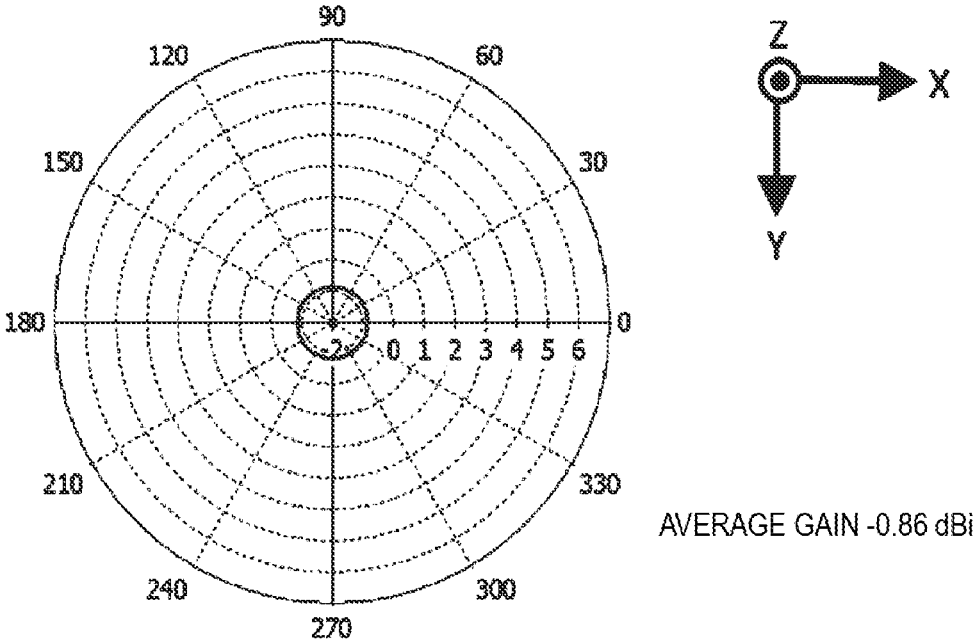
FIG. 25 A graph similarly illustrating the gain in horizontal plane of vertical polarized wave at 5887.5 MHz.
Figure 26:
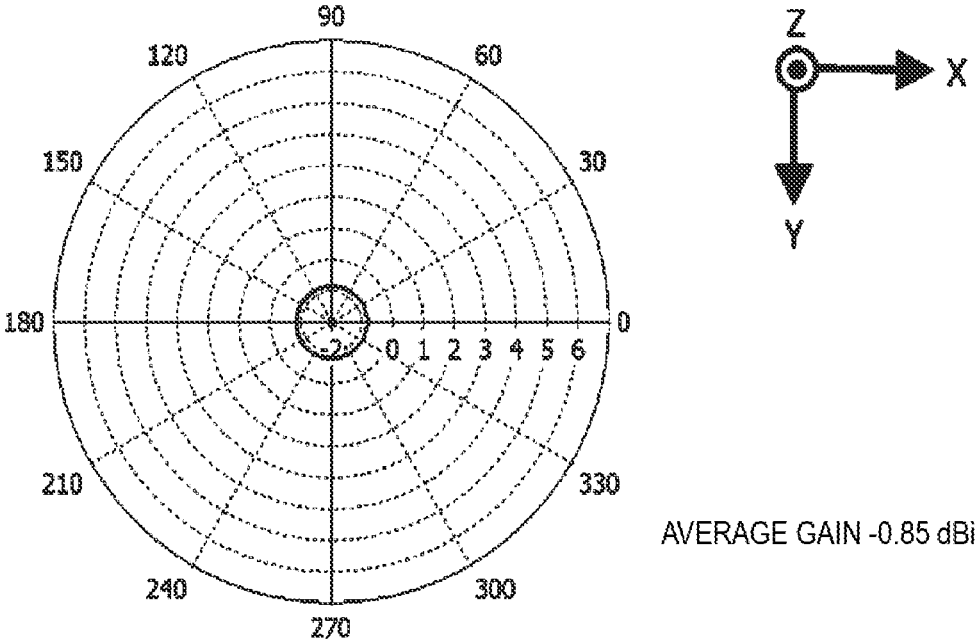
FIG. 26 A graph similarly illustrating the gain in horizontal plane of vertical polarized wave at 5925 MHz.
Figure 27A:
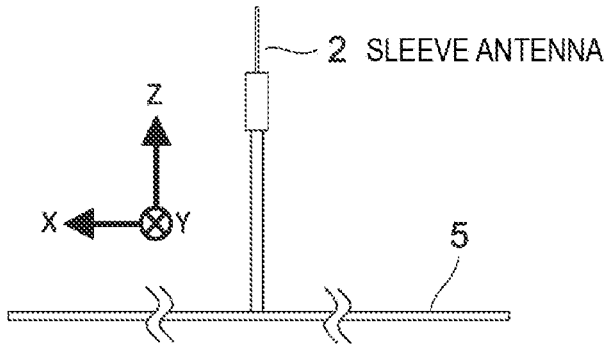
FIG. 27A A diagram illustrating a second conventional example in a state where a sleeve antenna is mounted on a circular ground plate having a diameter of 1 m.
Figure 27B:
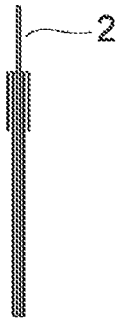
FIG. 27B A cross-sectional view illustrating the second conventional example where the circular ground plate having the diameter of 1 m is omitted.
Figure 28:
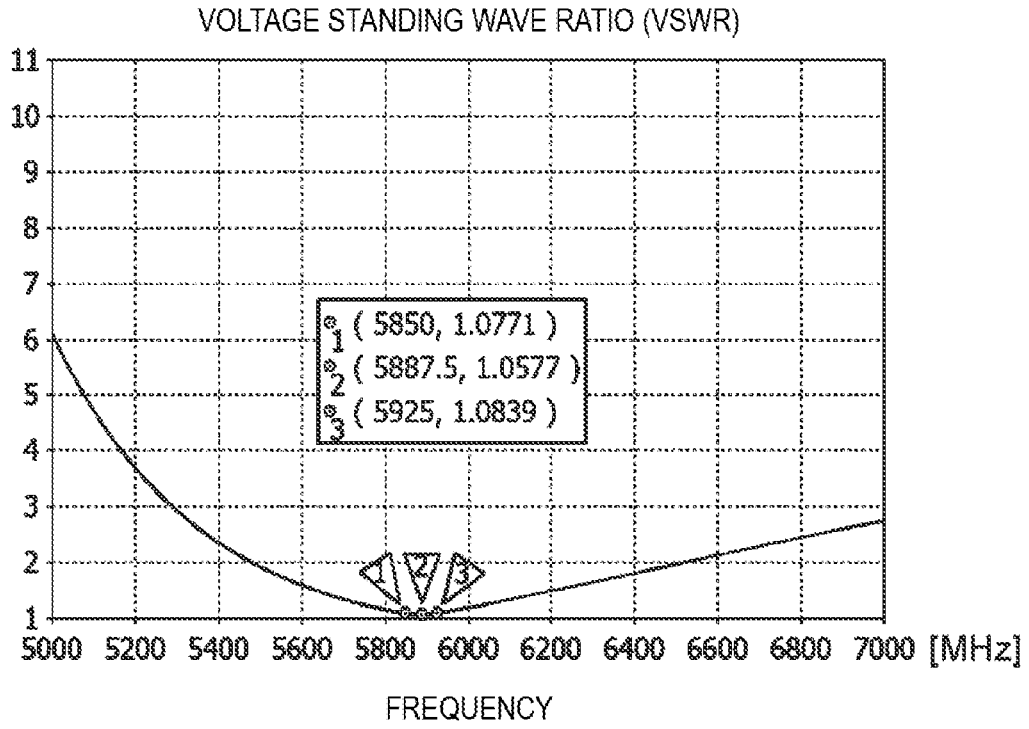
FIG. 28 A graph illustrating a VSWR-frequency characteristic in the case of the second conventional example.
Figure 29:
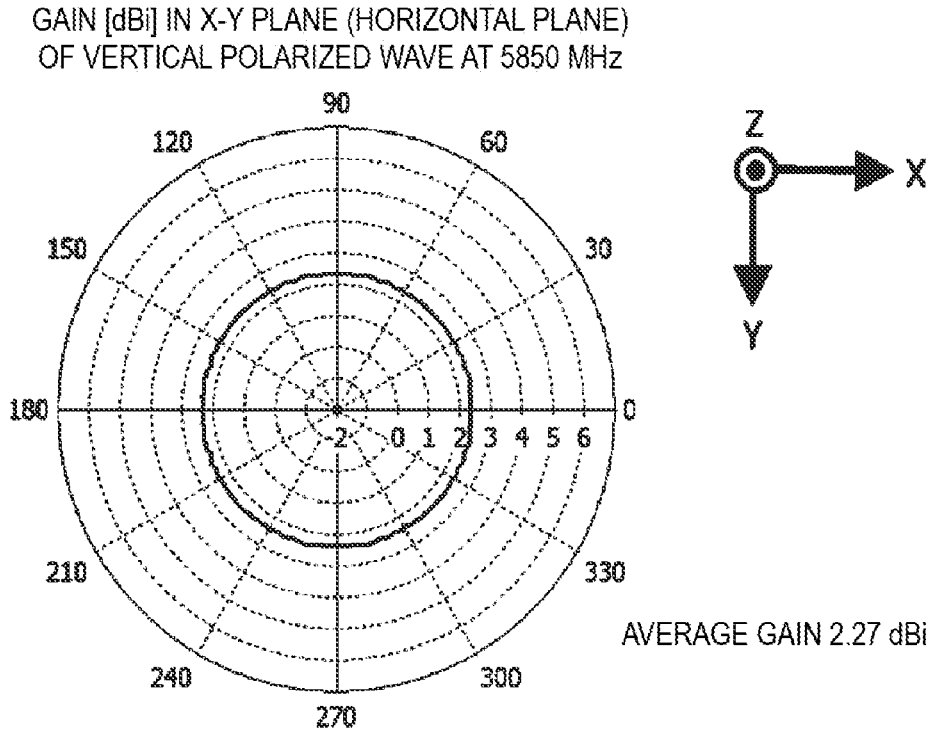
FIG. 29 A graph illustrating the gain in horizontal plane of vertical polarized wave at 5850 MHz in the case of the second conventional example.
Figure 30:
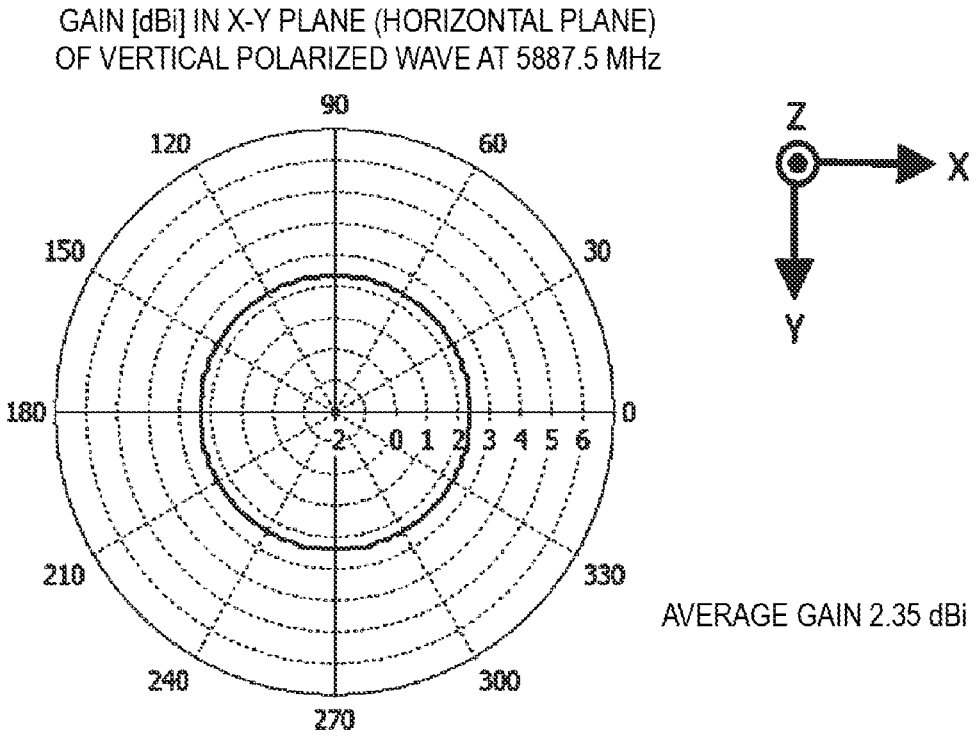
FIG. 30 A graph similarly illustrating the gain in horizontal plane of vertical polarized wave at 5887.5 MHz.
Figure 31:
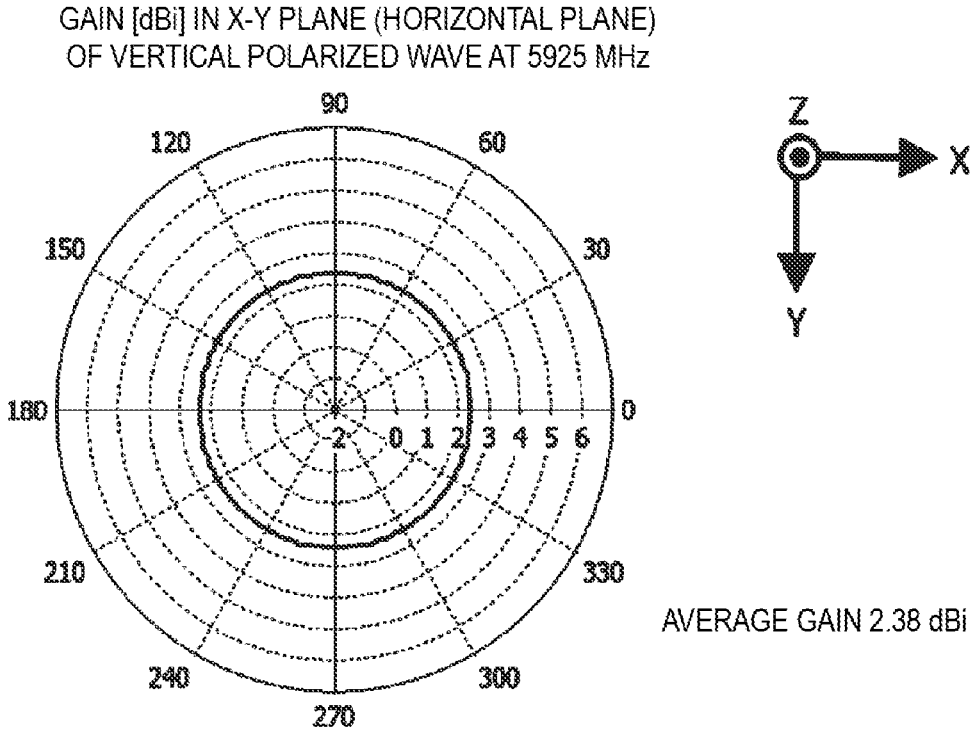
FIG. 31 A graph similarly illustrating the gain in horizontal plane of vertical polarized wave at 5925 MHz.

As shown in FIG. 18, the VSWR in the case of FIG. 17A and FIG. 17B is 1.2665 at 5850 MHz, and is 1.2301 at 5887.5 MHz, and is 1.203 at 5925 MHz. Also, the gain in horizontal plane of vertical polarized wave at 5850 MHz is shown in FIG. 19, and the average gain is 3.61 dBi. The gain in horizontal plane of vertical polarized wave at 5887.5 MHz is shown in FIG. 20, and the average gain is 3.58 dBi, and the gain in horizontal plane of vertical polarized wave at 5925 MHz is shown in FIG. 21, and the average gain is 3.61 dBi. As can be seen from FIG. 19 to FIG. 21, directivity in horizontal plane has the shape of a chain of two circles like "8". Directivity occurs in the direction along the substrate plane of the array antenna substrate 10C, and the gain in this direction increases, and the gain in the direction perpendicular to the substrate plane decreases.

According to the fourth embodiment, since the pair of dipole antenna arrays 30A and 30B are disposed apart from each other by about λ/2, it is possible to cause directivity (in the shape of a chain of two circles like "8") in the direction along the substrate plane, thereby increasing the gain in the directivity direction. For example, if the array antenna substrate 10C is mounted on the base 15 of FIG. 6, it has directivity in which high gain is obtained in the front-rear direction of the automobile.

Although the present invention has been described above using the embodiments as examples, it would be understood by those skilled in the art that the individual components and the individual processing processes in the embodiments can be variously modified within the scope of the claims. Hereinafter, modifications will be described.

In the above-described first and second embodiments, the individual dipole antennae 31 constituting the dipole antenna array 30 are arranged in a straight line in the Z-axis direction; however, the individual dipole antennae 31 may be moved in parallel with respect to each other. In this case, as compared to the case where the dipole antenna arrays are arranged in a straight line in the Z-axis direction, in one direction or both directions of the X-axis direction, the gain in X-Y plane of vertical polarized wave decreases.

In the above-described fourth embodiment, in the case where the distance between the dipole antenna array 30A provided on the left side of the array antenna substrate 10C and the dipole antenna array 30B provided on the right side is shorter than ½ of the wavelength λ, as compared to the case where the distance is λ/2, the average gain decreases. However, it is advantageous for reducing the size of the array antenna substrate 10C.

In the above-described fourth embodiment, the dipole antenna array 30A provided on the left side of the array antenna substrate 10C and the dipole antenna array 30B provided on the right side are excited (fed with power) in the opposite phases; however, the dipole antenna array 30B also may be configured in a conductor pattern similar to that of the dipole antenna array 30A (for example, such that all of the first elements and the third elements on the first surface of the dielectric substrate 20 are configured so as to be directed upward, and all of the second elements and the fourth elements on the second surface of the dielectric substrate 20 are configured so as to be directed downward) so as to be excited (fed with power) in the same phase, and in this case, the gain in the Y direction increases.

Figure 32A:
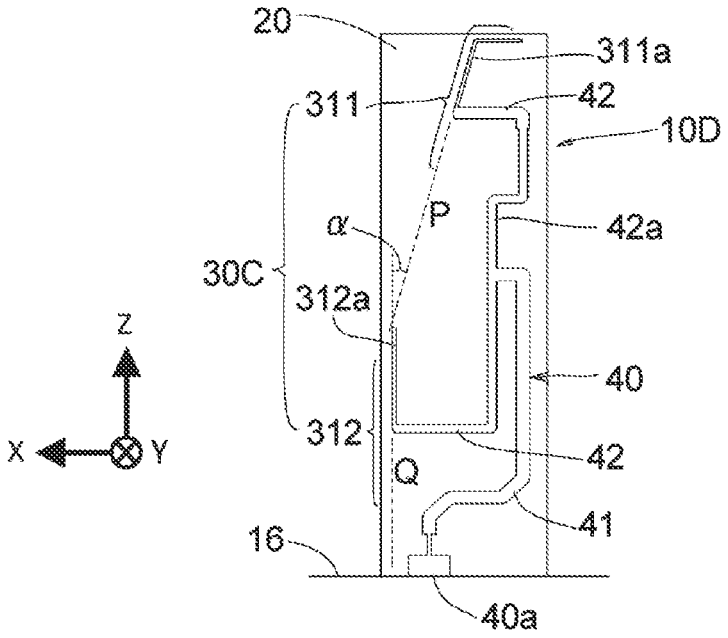
FIG. 32A A view illustrating a first surface of an array antenna substrate according to a fifth embodiment in the case of configuring a linear polarized wave array antenna device for vehicle as an antenna device for vehicle according to the present invention.
Figure 32B:
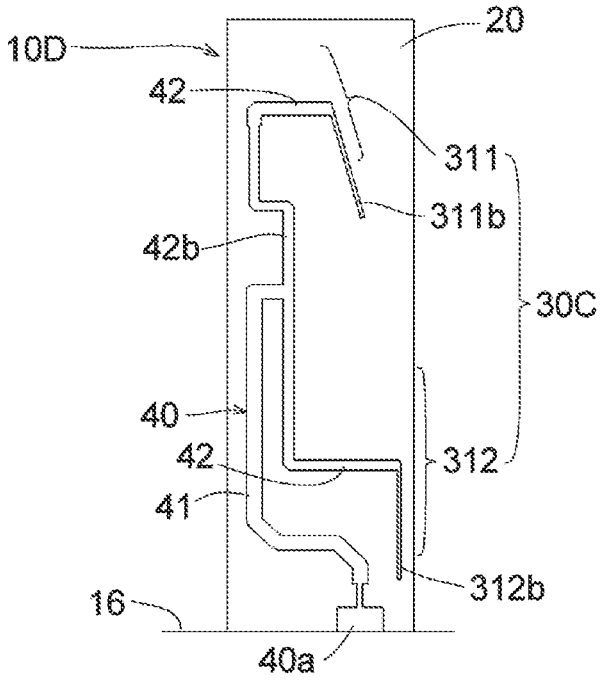
FIG. 32B A view illustrating a second surface of the array antenna substrate according to the fifth embodiment.

FIG. 32A and FIG. 32B show an array antenna substrate 10D according to a fifth embodiment in the case of configuring a linear polarized wave array antenna device for vehicle as an antenna device for vehicle according to the present invention. This array antenna substrate 10D includes a dipole antenna array 30C having an upper dipole antenna 311 and a lower dipole antenna 312 provided on the dielectric substrate 20. A difference between this array antenna substrate 10D and the array antenna substrate 10 shown in the first embodiment is that in the direction perpendicular to the arrangement direction of the lower dipole antenna 312 (the width direction of the dielectric substrate 20), the position of the connection part between the upper dipole antenna 311 and a transmission line 40 provided on the dielectric substrate 20 is different from the position of the connection part between the lower dipole antenna 312 and the transmission line 40. In other words, on the first surface of the dielectric substrate 20, the place where conductor patterns forming first elements 311*a* of the upper dipole antenna 311 and first conductor patterns 42*a* of branch transmission line parts 42 are connected and the place where conductor patterns forming first elements 312*a* of the lower dipole antenna 312 and first conductor patterns 42*a* of branch transmission line parts 42 are connected are apart in the front-rear direction, i.e. in the width direction of the dielectric substrate 20 (the left-right direction of FIG. 32A and FIG. 32B: the X-axis direction), and on the second surface of the dielectric substrate 20, the place where conductor patterns forming second elements 311*b* of the upper dipole antenna 311 and second conductor patterns 42*b* of branch transmission line parts 42 are connected and the place where conductor patterns forming second elements 312*b* of the lower dipole antenna 312 and second conductor patterns 42*b* of branch transmission line parts 42 are connected are apart in the front-rear direction. Also, the upper parts of the first elements 311*a* of the upper dipole antenna 311 are bent along the upper side of the dielectric substrate 20, and this is because the height of the dielectric substrate 20 is insufficient; however, unless the bent parts are excessively large, it does not have a great influence on the characteristic for serving as a monopole antenna.

One difference between the array antenna substrate 10D and the array antenna substrate 10 shown in the first embodiment is that the arrangement direction of the upper dipole antenna 311 (shown by a straight line P) is inclined with respect to the arrangement direction of the lower dipole antenna 312 (shown by a straight line Q). In other words, in the case where the array antenna substrate 10D is installed vertically on the mounting substrate (a mounting member) 16 fixed on the base 15 shown in FIG. 6, on the first surface of the dielectric substrate 20, the first elements 312*a* of the lower dipole antenna 312 are arranged in the vertical direction of the dielectric substrate 20; whereas the first elements 311*a* of the upper dipole antenna 311 are arranged so as to be inclined with respect to the vertical direction of the dielectric substrate 20, and on the second surface of the dielectric substrate 20, the second elements 312*b* of the lower dipole antenna 312 are arranged in the vertical direction of the dielectric substrate 20; whereas the second elements 31*b* of the upper dipole antenna 311 are arranged so as to be inclined with respect to the vertical direction of the dielectric substrate 20. The inclination of the straight line P which is the arrangement direction of the upper dipole antenna 311 shown in FIG. 32A is set such that the directivity of the vertical surface of the upper dipole antenna 311 in the positive direction of the X axis is directed slightly upward. The angle $\alpha$ between the straight line P and the straight line Q which is the arrangement direction of the lower dipole antenna 312 is a small angle less than 45°. The other configuration is similar to that of the first embodiment.

As for the external dimensions of the array antenna substrate 1 OD, for example, the height in the Z-axis direction is 51.50 mm, and the width in the X-axis direction is 14.50 mm, and the thickness in the Y-axis direction is 0.75 mm. These dimensions are shape dimensions appropriate for an antenna device for vehicle which can be mounted on the roof of a vehicle.

Figure 33A:
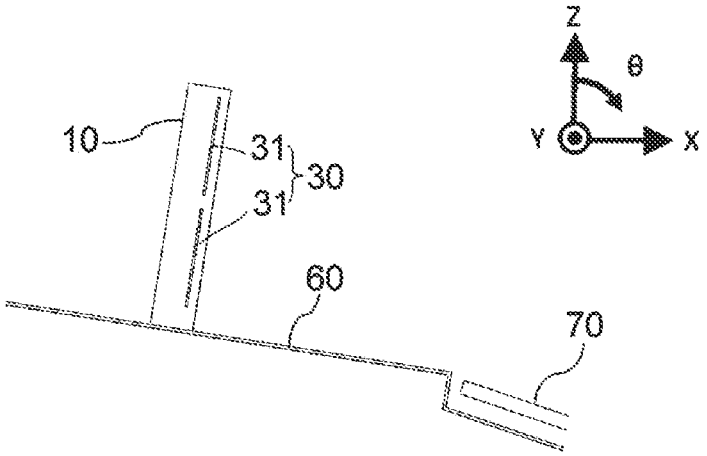
FIG. 33A A schematic diagram illustrating a measurement model in the case where a glass sheet is adjacent to an inclined roof of a vehicle when an array antenna substrate 10 of the first embodiment is disposed on the root.
Figure 33B:
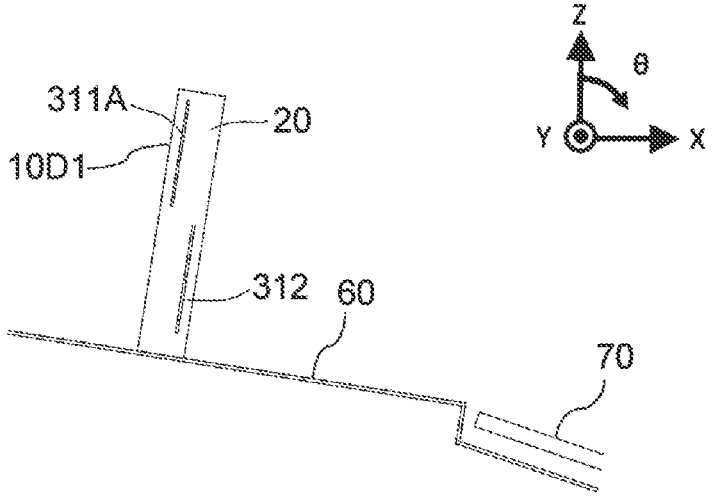
FIG. 33B A schematic diagram illustrating a measurement model in the case where a glass sheet is adjacent to the inclined roof of a vehicle when an array antenna substrate 10D1 approximates an array antenna substrate 10D of the fifth embodiment is disposed on the roof.

FIG. 33A is a schematic diagram illustrating a measurement model in the case where a glass sheet 70 is adjacent to an inclined roof 60 of a vehicle when the array antenna substrate 10 of the first embodiment is disposed on the roof 60, and FIG. 33B is a schematic diagram similarly illustrating a measurement model in the case where a glass sheet 70 is adjacent to the roof 60 when an array antenna substrate 10D1 approximates the array antenna substrate 10D of the fifth embodiment is disposed on the roof 60. In FIGS. 33A and 33B, the array antenna substrate 10 or 10D1 is installed vertically on the roof 60 of the vehicle to be positioned near the glass sheet 70. Also, in FIG. 33A and FIG. 33B, the transmission lines 40 are omitted, and the array antenna substrate 10 and the array antenna substrate 10D1 are inclined at an angle of about 9° with respect to the horizontal planes (the X-Y planes) of FIG. 33A and FIG. 33B. This is because the roofs 60 of the vehicles which are adjacent to the glass sheets 70 and where the array antenna substrate 10 and the array antenna substrate 10D1 are provided are inclined at the angle of about 9° with respect to the horizontal planes (the X-Y planes) of the vehicles. Further, as shown in FIG. 33B, in the army antenna substrate 10D1, the position of a connection part between an upper dipole antenna 311A provided on the dielectric substrate 20 (corresponding to the case where the inclination of a dipole antennae 311 is zero) and a transmission line and the position of a connection part between a lower dipole antenna 312 and the transmission line are apart in the front-rear direction, but both of their arrangement directions are vertical to the roof 60 and are parallel to each other.

Figure 34:
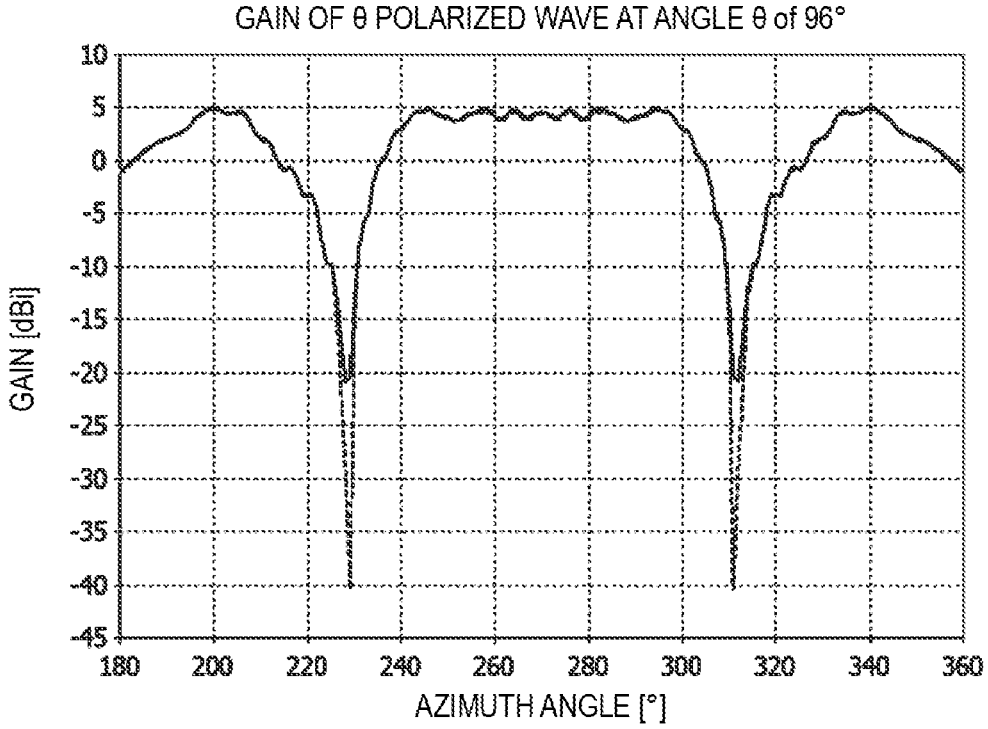
FIG. 34 A graph illustrating the gain of θ polarized wave at an angle θ of 96° which is obtained by a simulation in each of the case of the measurement model of FIG. 33A using the array antenna substrate 10 of the first embodiment and the case of the measurement model of FIG. 33B using the army antenna substrate 10D1 approximates the array antenna substrate 10D of the fifth embodiment.

FIG. 34 is a graph illustrating the gain of $\theta$ polarized wave (wherein the angle $\theta$ is 96° with reference to the positive direction of the Z axis of FIG. 33A or 33B) at the frequency of 5887.5 MHz which is obtained by simulations in the case of the measurement model of FIG. 33A using the array antenna substrate 10 of the first embodiment and the case of the measurement model of FIG. 33B using the array antenna substrate 10D1 approximates the array antenna substrate 10D of the fifth embodiment (wherein the horizontal axis represents azimuth angle between 180° and 360° and the vertical axis represents the gain in dBi), and shows the characteristic in the case of the measurement model of FIG. 33A by a dotted line and the characteristic in the case of the measurement model of FIG. 33B by a solid line. Also, in FIG. 34, an azimuth angle of 270° is the direction in which the dipole antenna array is positioned on the dielectric substrate 20 (the positive direction of the X axis).

In the case of the measurement model of FIG. 33A, since the array antenna substrate 10 has the dipole antenna array 30 having the upper and lower dipole antennae 31 arranged in a straight line, at the angle θ (for example, an angle θ of 96°) attributable to the existence of the glass sheet 70, azimuth angles at which the gain of θ polarized wave of the upper dipole antenna falls and azimuth angles at which the gain of θ polarized wave of the lower dipole antenna falls become substantially the same as each other. This is because the distances between the individual dipole antennae 31 and the glass sheet 70 are substantially the same. Therefore, in the characteristic shown by the dotted line in FIG. 34 and corresponding to the measurement model of FIG. 33A, falling of the gain at the azimuth angles of about 230° and about 310° is significantly large.

Meanwhile, in the case of the measurement model of FIG. 33B, since in the array antenna substrate 10D1, the positions of the upper and lower dipole antennae 311A and 312 in the front-rear direction are apart, at the angle θ (for example, an angle θ of 96°) attributable to the existence of the glass sheet 70, azimuth angles at which the gain of θ polarized wave of the upper dipole antenna 311A falls and the azimuth angles at which the gain of θ polarized wave of the lower dipole antenna 312 falls are different (deviated) from each other. Therefore, in the characteristic shown by the solid line in FIG. 34 and corresponding to the measurement model of FIG. 33B, falling of the gain at the azimuth angles of about 230° and about 310° becomes smaller as compared to the measurement model of FIG. 33A, and falling of the gain improves.

Figure 35A:
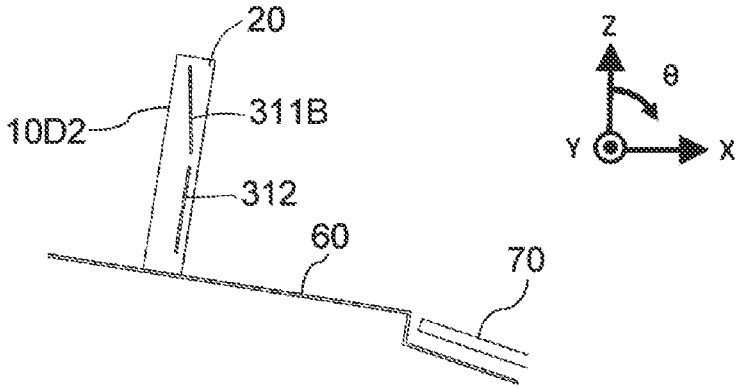
FIG. 35A A schematic diagram illustrating a measurement model in the case where a glass sheet is adjacent to an inclined roof of a vehicle when an array antenna substrate 10D2 approximates the array antenna substrate 10D of the fifth embodiment is disposed on the roof.

FIG. 35A is a schematic diagram illustrating a measurement model in the case where a glass sheet 70 is adjacent to an inclined roof 60 of a vehicle when an array antenna substrate 10D2 approximates the array antenna substrate 10D of the fifth embodiment is disposed on the roof 60. The array antenna substrate 10D2 is installed vertically on the roof 60 of the vehicle so as to be positioned near the glass sheet 70. In the array antenna substrate 10D2, the element arrangement direction of an upper dipole antenna 311B provided on the dielectric substrate 20 (corresponding to the case where the bent parts of the dipole antennae 311 are linearly extended) and the element arrangement direction of a lower dipole antenna 312 are not parallel, and with respect to one, the other is inclined. In other words, the lower dipole antenna 312 is vertical to the roof 60; whereas the upper dipole antenna 311B is not vertical to the roof 60 (the upper dipole antenna is inclined in the front-rear direction with respect to the front edge of the dielectric substrate 20). Also, in FIG. 35A, the transmission lines 40 are omitted.

Figure 35B:
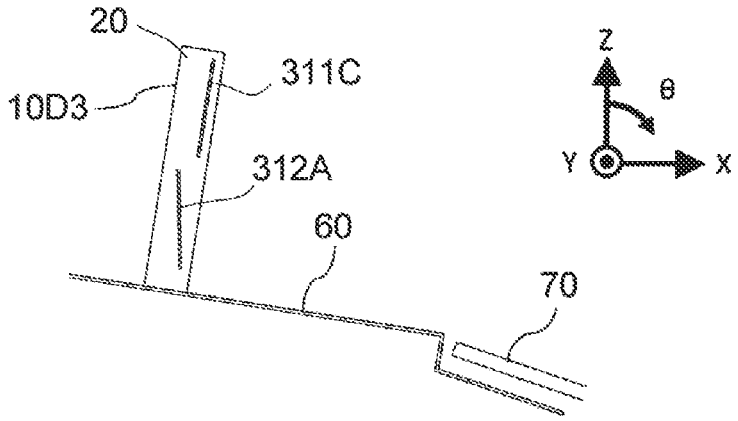
FIG. 35B A schematic diagram illustrating a measurement model in the case where a glass sheet is adjacent to an inclined roof of a vehicle when an array antenna substrate 10D3 which is a comparative example is disposed on the roof.

FIG. 35B is a schematic diagram illustrating a measurement model in the case where a glass sheet 70 is adjacent to an inclined roof 60 of a vehicle when an array antenna substrate 10D3 which is a comparative example is disposed on the roof 60. In this case, the element arrangement direction of an upper dipole antenna 311C provided on the dielectric substrate 20 (corresponding to the case where the bent parts of the dipole antennae 311 are linearly extended) is vertical to the roof 60; whereas the element arrangement direction of a lower dipole antenna 312A is not vertical to the roof 60 (the upper dipole antenna is inclined in the front-rear direction with respect to the front edge of the dielectric substrate 20). The other configuration is the same as that of the measurement model of FIG. 35A.

Figure 36:
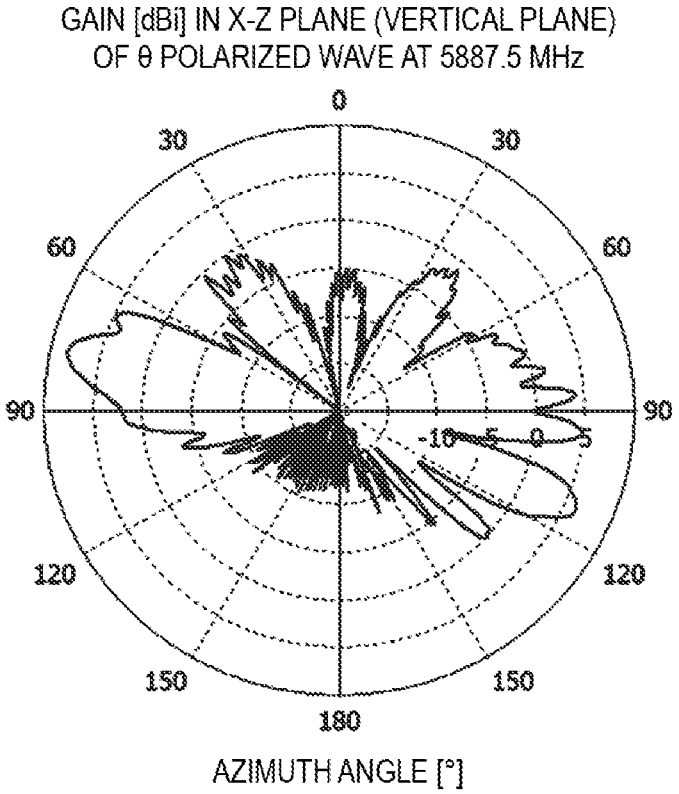
FIG. 36 A graph illustrating the gain of θ polarized wave which is obtained by a simulation in the case of the measurement model of FIG. 35A using the array antenna substrate 10D2 approximates the array antenna substrate 10D of the fifth embodiment.

FIG. 36 is a graph illustrating the gain in X-Z plane (vertical plane) of θ polarized wave at the frequency of 5887.5 MHz which is obtained by in the case of the measurement model of FIG. 35A using the array antenna substrate 10D2 similar to the array antenna substrate 10D of the fifth embodiment. An angle θ of 90° on the right side of FIG. 36 is the horizontal direction (the positive direction of the X axis) of the side of the dielectric substrate 20 where the dipole antenna array is positioned, and an angle θ of about 114° on the right side of FIG. 36 is the direction substantially parallel with the glass sheet 70.

In the case of the array antenna substrate 10 shown in the first embodiment, the upper and lower dipole antennae 31 are arranged in a straight line, and the arrangement directions of the individual dipole antennae are not inclined with respect to each other. In this case, if the array antenna substrate 10 is disposed close to the surface of the glass sheet which is not parallel with the base 15 like the measurement model of FIG. 33A, a phenomenon in which the gain in vertical plane of the elements becomes high at the angle θ of a direction substantially parallel with the surface of the glass sheet and falls in view of the angle θ of 90° may occur. As a countermeasure to that, in the array antenna substrate 10D of the fifth embodiment, the directivity in the vertical plane is set to be directed slightly upward by inclining the upper dipole antenna 311, such that the gain of θ polarized wave is prevented from falling. The result of a simulation of the above-mentioned configuration at the frequency of 5887.5 MHz is the characteristic diagram of FIG. 36.

As shown in FIG. 36, in the array antenna substrate 10D2 of the measurement model of FIG. 35A, the gain of θ polarized wave at the angle θ of 90° shown on the right side of FIG. 36 was −0.4 dB, and the gain of θ polarized wave at the angle θ of 114° shown on the right side of FIG. 36 was 6.1 dB. Meanwhile, when a simulation similar to that of the measurement model of FIG. 35A was performed with respect to the array antenna substrate 10 shown in the first embodiment, the gain of θ polarized wave corresponding to the angle θ of 90° shown on the right side of FIG. 36 was −1.5 dB, and the gain of θ polarized wave corresponding to the angle θ of 114° shown on the right side of FIG. 36 was 6.5 dB. Like this, in the array antenna substrate 10D2, as compared to the array antenna substrate 10, the gain increased at the angle θ of 90° corresponding to the side of the dielectric substrate 20 where the dipole antenna array 30 was positioned, and decreased in the direction parallel with the glass sheet 70.

Also, when a simulation similar to that of the measurement model of FIG. 35A was performed with respect to the measurement model of FIG. 35B as a comparative example, the gain of θ polarized wave corresponding to the angle θ of 90° shown on the right side of FIG. 36 was −1.5 dB, and the gain of θ polarized wave corresponding to the angle θ of 114° shown on the right side of FIG. 36 was 6.5 dB. In other words, in the array antenna substrate 10D3, as compared to the array antenna substrate 10, between the gain of θ polarized wave at the angle θ of 90° corresponding to the side of the dielectric substrate 20 where the dipole antenna array is positioned and the gain of θ polarized wave in a direction substantially parallel with the glass sheet 70, there is not much difference. Like the measurement model of FIG. 35B, since even though the lower dipole antenna of the dielectric substrate 20 is inclined, the effect is less, in the fifth embodiment shown in FIG. 32A and FIG. 32B, the arrangement directions of the elements 311*a* and 311*b* of the upper dipole antenna 311 are inclined with respect to the vertical direction of the dielectric substrate 20.

Figure 37:
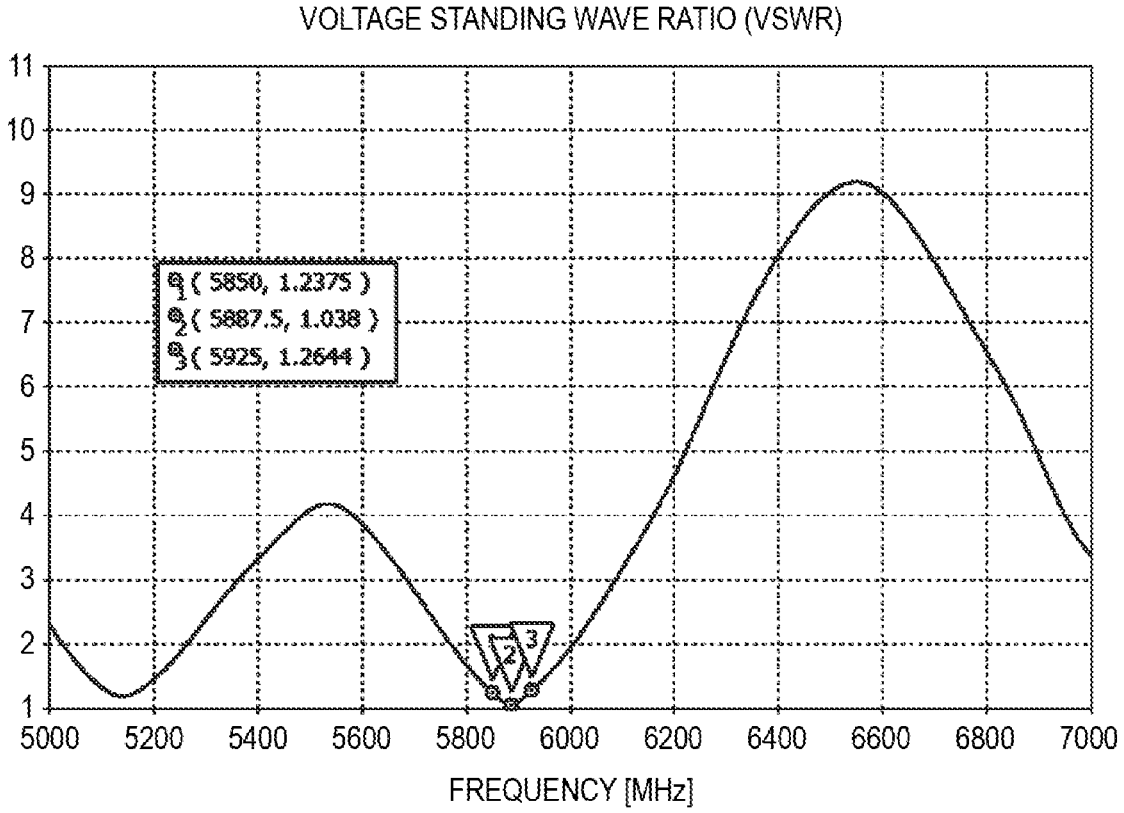
FIG. 37 A graph illustrating a VSWR-frequency characteristic in the case of the fifth embodiment.
Figure 38:
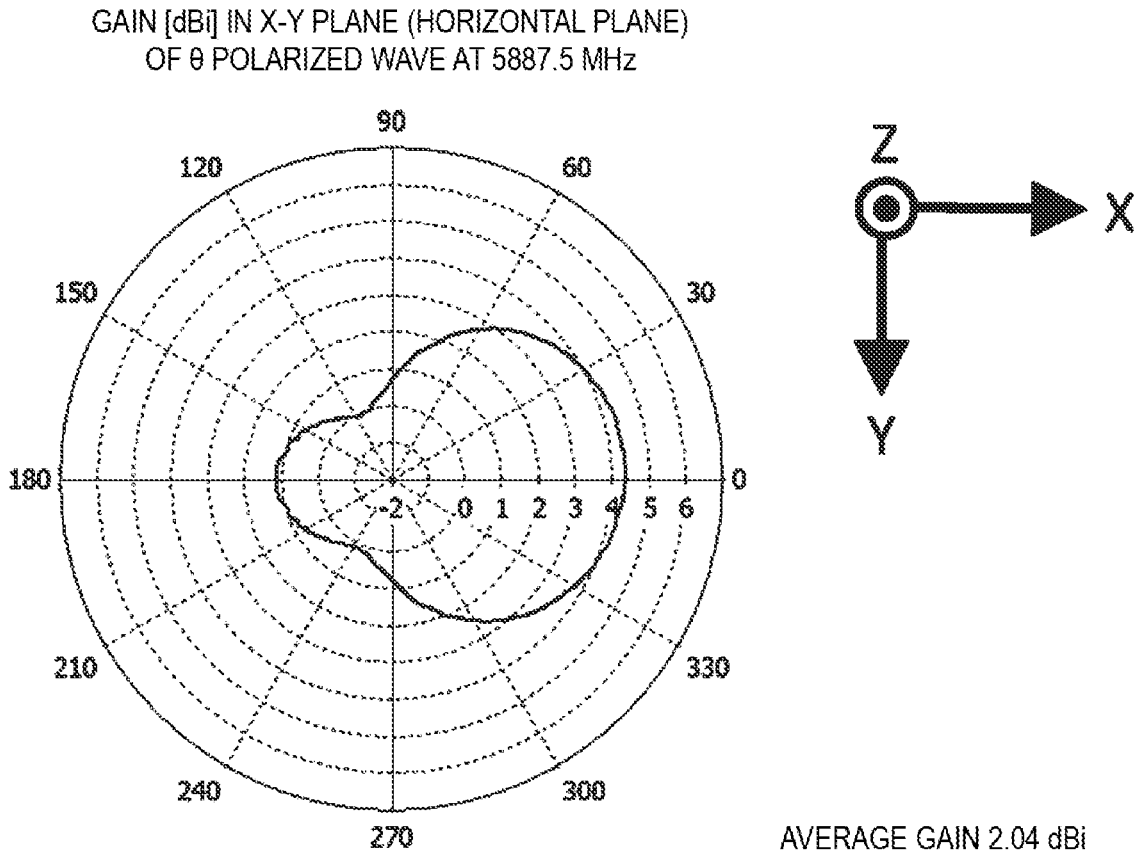
FIG. 38 A graph illustrating the gain of θ polarized wave at 5887.5 MHz in the case of the fifth embodiment.

FIG. 37 is a graph illustrating the VSWR-frequency characteristic in the case of the fifth embodiment, and the VSWR becomes 1.2375 at 5850 MHz, and becomes 1.038 at 5887.5 MHz, and becomes 1.2644 at 5925 MHz, and these values are sufficiently low. Also, FIG. 38 is a graph illustrating the gain in X-Y plane (horizontal plane) of θ polarized wave (vertical polarized wave) at 5887.5 MHz in the case of the fifth embodiment, and the average gain is 2.04 dBi. The measurement condition is the same as that in the case of FIG. 4.

As described above, according to the fifth embodiment, it is possible to achieve the following effects.

(1) In the case where the array antenna substrate 10D is installed vertically on the roof 60 of the vehicle so as to be positioned adjacent to the glass sheet 70, on the first surface of the dielectric substrate 20, the place where the conductor patterns forming the first elements 311*a* of one dipole antenna 311 and the first conductor patterns 42*a* of the branch transmission line parts 42 are connected and the place where the conductor patterns forming the first elements 312*a* of the other dipole antenna 312 and the first conductor patterns 42*a* of the branch transmission line parts 42 are apart in the width direction of the dielectric substrate 20, and on the second surface of the dielectric substrate 20, the place where the conductor patterns forming the second elements 311*b* of the dipole antenna 311 and the second conductor patterns 42*b* of the branch transmission line parts 42 and the place where the conductor patterns forming the second elements 312*b* of the dipole antenna 312 and the second conductor patterns 42*b* of the branch transmission line parts 42 are connected are apart in the front-rear direction. Therefore, the azimuth angles at which the gain of θ polarized wave of the dipole antenna 311 falls and the azimuth angles at which the gain of θ polarized wave of the dipole antenna 312 falls are different from each other. Hence, it is possible to prevent the gain of θ polarized wave of the array antenna substrate 10D from falling at specific azimuth angles.

(2) In the case where the array antenna substrate 10D is installed vertically on the roof 60 of the vehicle so as to be positioned adjacent to the glass sheet 70, the arrangement directions of the first elements 311*a* and the second elements 311*b* of the upper dipole antenna 311 are inclined with respect to the arrangement directions of the first elements 311*a* and the second elements 311*b* of the lower dipole antenna 312 such that the directivity in vertical plane of the upper dipole antenna 311 is set to be directed slightly upward. Therefore, it is possible to prevent the gain of θ polarized wave at the angle θ of 96° attributable to the glass sheet 70 from falling.

Figure 39A:
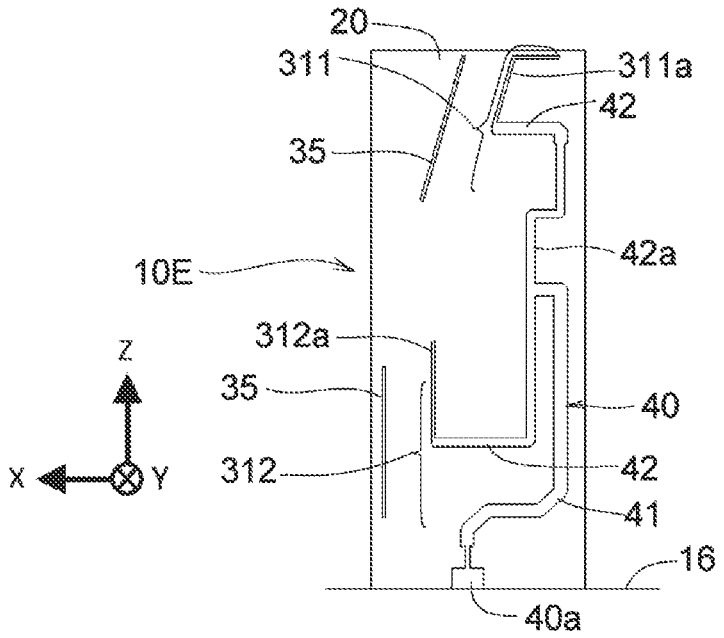
FIG. 39A A diagram illustrating a first surface of an array antenna substrate according to a sixth embodiment in the case of configuring a linear polarized wave array antenna device for vehicle as an antenna device for vehicle according to the present invention.
Figure 39B:
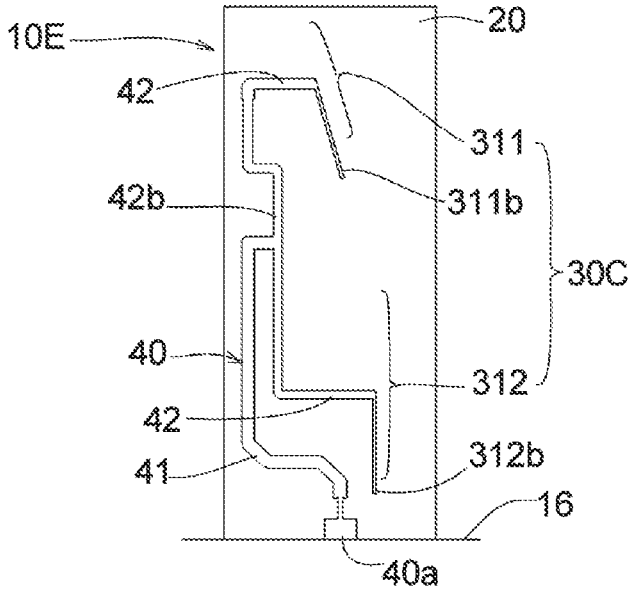
FIG. 39B A diagram illustrating a second surface of the array antenna substrate according to the sixth embodiment.

FIG. 39A and FIG. 39B show an array antenna substrate 10E according to a sixth embodiment in the case of configuring a linear polarized wave array antenna device for vehicle as an antenna device for vehicle according to the present invention. A difference between this array antenna substrate 10E and the array antenna substrate 10D shown in the fifth embodiment is that wave directors 35 are disposed in parallel with the dipole antennas 311 and 312, respectively. Since the wave directors 35 are disposed, it is possible to increase the directivity gain of the side where the wave directors 35 are disposed. For example, if the array antenna substrate 10E is mounted on the base 15 such that the wave directors 35 are positioned on the rear side, it has directivity in which high gain is obtained in the opposite direction to the traveling direction of the automobile.

Figure 40:
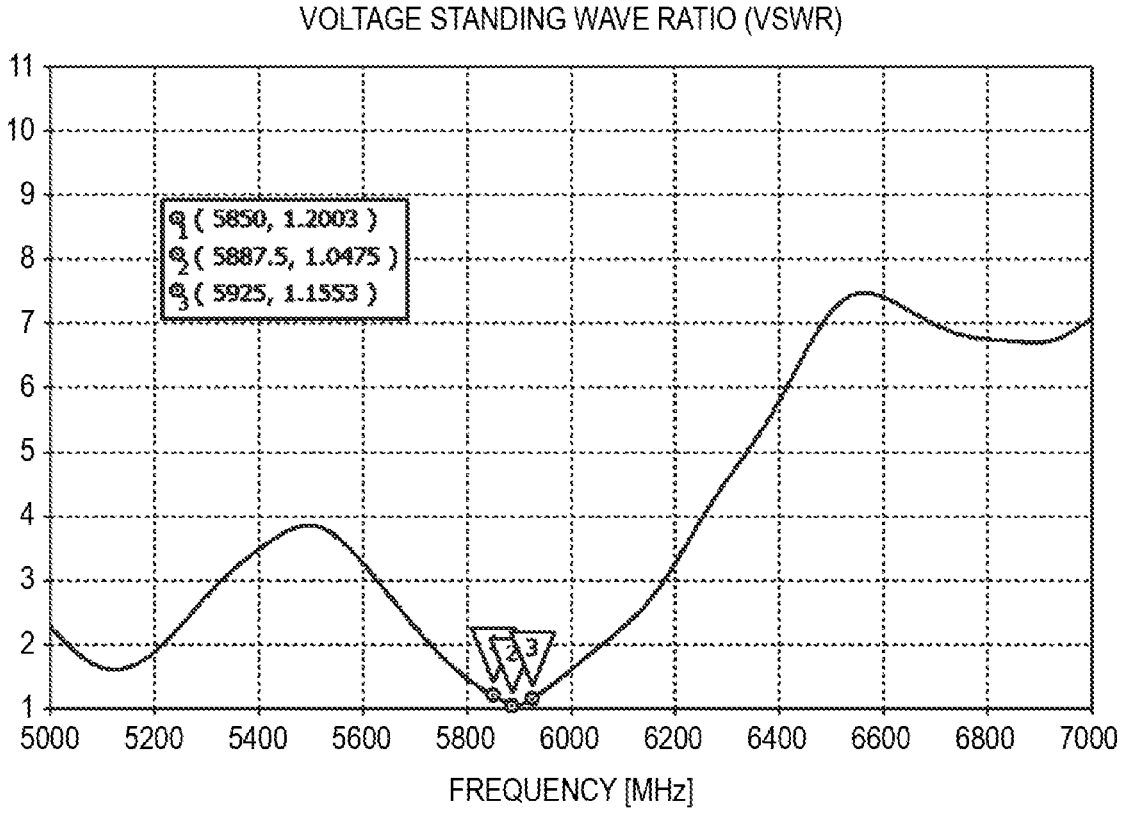
FIG. 40 A graph illustrating a VSWR-frequency characteristic in the case of the sixth embodiment.
Figure 41:
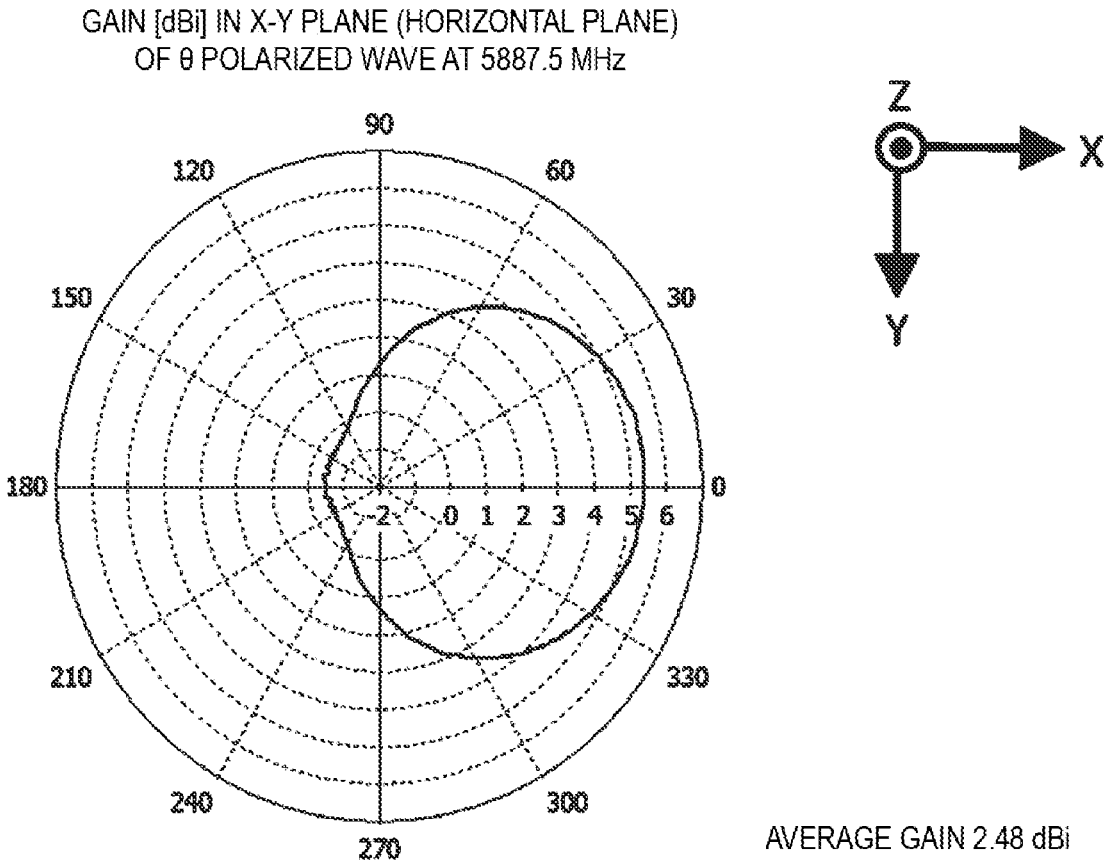
FIG. 41 A graph illustrating the gain of θ polarized wave at 5887.5 MHz in the case of the sixth embodiment.

In the case of the sixth embodiment shown in FIG. 39A and FIG. 39B, as shown in FIG. 40, the VSWR is 1.2003 at 5850 MHz, and is 1.0475 at 5887.5 MHz, and is 1.1553 at 5925 MHz, and these values are sufficiently low. Also, FIG. 41 is a graph illustrating the gain in X-Y plane (horizontal plane) of θ polarized wave (vertical polarized wave) at 5887.5 MHz in the case of the sixth embodiment, and the average gain is 2.48 dBi. The measurement condition is the same as that in the case of FIG. 4.

Also, in the sixth embodiment, the configuration in which the wave directors 35 are provided on the first surface of the dielectric substrate 20 has been described; however, wave directors 35 may be provided on the second surface, and wave directors 35 may be provided on both of the first surface and the second surface.

As for the external dimensions of the array antenna substrate 10E, for example, the height is 51.50 mm, and the width is 18.80 mm, and the thickness is 0.75 mm. These dimensions are shape dimensions appropriate for an antenna device for vehicle which can be mounted on the roof of a vehicle.

Figure 42A:
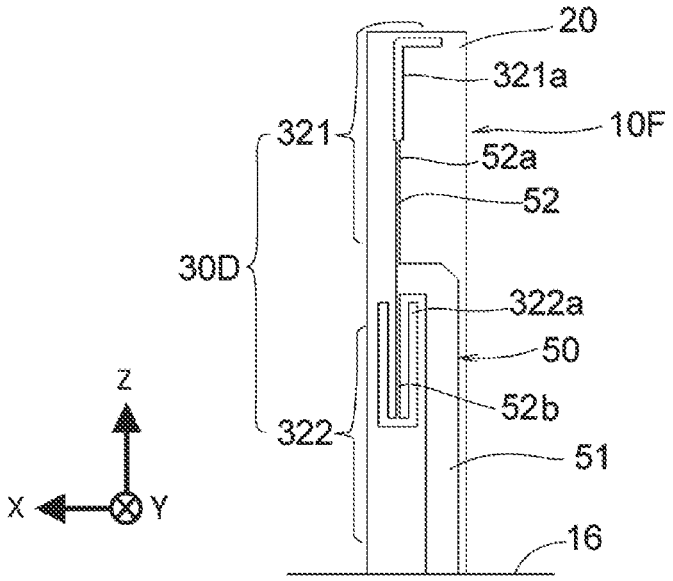
FIG. 42A A diagram illustrating a first surface of an array antenna substrate according to a seventh embodiment in the case of configuring a linear polarized wave array antenna device for vehicle as an antenna device for vehicle according to the present invention.
Figure 42B:
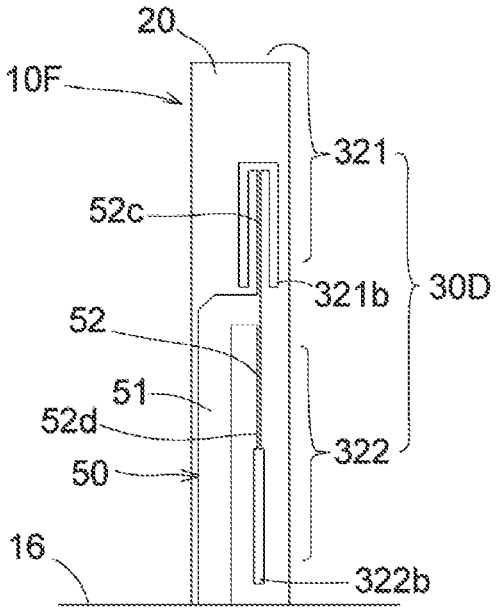
FIG. 42B A diagram illustrating a second surface of the array antenna substrate according to the seventh embodiment.

FIG. 42A and FIG. 42B show an array antenna substrate 10F according to a seventh embodiment in the case of configuring a linear polarized wave array antenna device for vehicle as an antenna device for vehicle according to the present invention. This array antenna substrate 10F has a dipole antenna array 30D and two parallel transmission lines 50 formed on a dielectric substrate 20, and the dipole antenna array 30D includes an upper dipole antenna 321 and a lower dipole antenna 322 arranged in the vertical direction of the dielectric substrate 20, i.e. in a straight line in the Z-axis direction, and the array antenna substrate 10F is different from the array antenna substrate 10 of the first embodiment in that a part of each transmission line 50 is surrounded by elements of one of the dipole antennae 321 and 322.

In other words, the transmission lines 50 have common transmission line parts 51 which are used in common for feeding power to all dipole antennae 321 and 322, and branch transmission line parts 52 which branch from the common transmission line parts 41 (in a T shape) and are used for feeding power to the individual dipole antennae 321 and 322, and on the first surface of the dielectric substrate 20, the leading ends of first conductor patterns 52*a* of the branch transmission line parts 52 are connected to conductor patterns forming first elements 321*a* of the dipole antenna 321, and the leading ends of second conductor patterns 52*b* of the branch transmission line parts 52 are connected to conductor patterns forming first elements 322*a* of the dipole antenna 322, and the second conductor patterns 52*b* are surrounded by the first elements 322*a*. Each first element 322*a* has parts extending in parallel near both sides of a second conductor pattern 52*b*. Also, on the second surface of the dielectric substrate 20, the leading ends of third conductor patterns 52*c* of the branch transmission line part 52 are connected to conductor patterns forming second elements 321*b* of the dipole antenna 321, and the leading ends of fourth conductor patterns 52*d* of the branch transmission line parts 52 are connected to conductor patterns forming second elements 322*b* of the dipole antenna 322, and the third conductor patterns 52*c* are surrounded by the second elements 321*b*. Each second element 321*b* has parts extending in parallel near both sides of a third conductor pattern 52*c*.

Also, the two parallel transmission lines 50 are parallel stripe lines which are configured on the first surface of the dielectric substrate 20 and the second surface opposing the first surface, respectively, so as to form a pair of conductor patterns having the same line width and having the same shape as seen from one surface. The other configuration is similar to that of the first embodiment.

As for the external dimensions of the array antenna substrate 10F, for example, the height is 51.50 mm, and the width is 8.60 mm, and the thickness is 0.75 mm. These dimensions are shape dimensions appropriate for an antenna device for vehicle which can be mounted on the roof of a vehicle.

Since the branch transmission line parts 42 of the first embodiment are conductors, they may function as antenna elements. For this reason, in the first embodiment, the electric length of the branch transmission line part 42 is set to such a length that the function of the individual dipole antennae 31 is not influenced. However, in the seventh embodiment, since the second conductor patterns 52*b* of the branch transmission line parts 52 are surrounded by the first elements 322*a* of the dipole antenna 322, and the third conductor patterns 52*c* of the branch transmission line parts 52 are surrounded by the second elements 321*b* of the dipole antenna 321, it becomes difficult for the second conductor patterns 52*b* and the third conductor patterns 52*c* of the branch transmission line parts 52 to function as radiation sources on the same principle as that of a Sperrtop balun, and it becomes difficult to influence the directivity of each dipole antenna 321 or 322. Therefore, in the seventh embodiment, with respect to the electric length of the branch transmission line parts 52, the need to consider the wavelength of the resonant frequency of the individual dipole antennae 321 and 322 is lower than that in the first embodiment. Herein, in the first embodiment, with respect to the electric length of the branch transmission line parts 42, in view of the wavelength of the resonant frequency of the dipole antennae 31, the electric length of the branch transmission line parts 42 is set to such a length that it is difficult to influence the resonant frequency of the dipole antennae 31. For this reason, in the seventh embodiment, as compared to the first embodiment configured in view of the wavelength of the resonant frequency of the dipole antennae 31, it is possible to reduce the electric length of the branch transmission line parts 52. As a result, it is possible to reduce the length of the dielectric substrate 20 in the front-rear direction.

Figure 43:
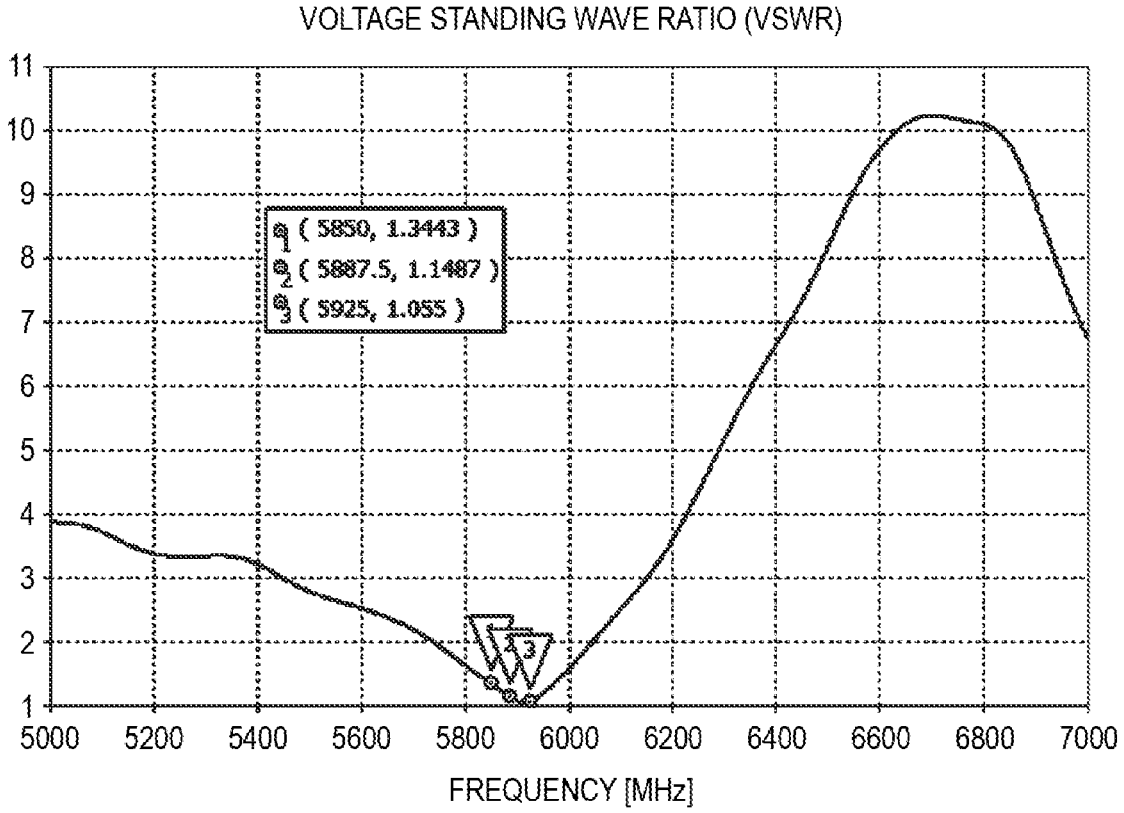
FIG. 43 A graph illustrating a VSWR-frequency characteristic in the case of the seventh embodiment.
Figure 44:
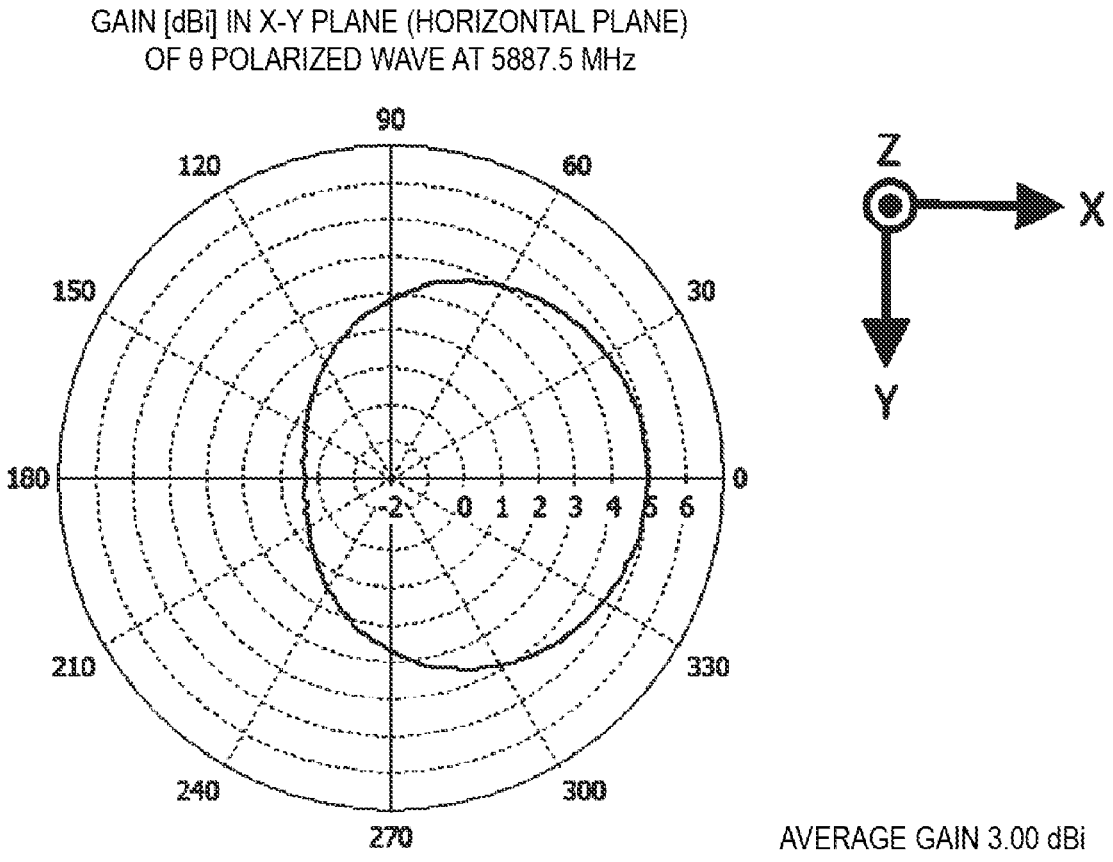
FIG. 44 A graph illustrating the gain of θ polarized wave at 5887.5 MHz in the case of the seventh embodiment.

In the case of the seventh embodiment shown in FIG. 42A and FIG. 42B, as shown in FIG. 43, the VSWR is 1.3433 at 5850 MHz, and is 1.1487 at 5887.5 MHz, and is 1.055 at 5925 MHz. Also, the gain in X-Y plane (horizontal plane) of θ polarized wave (vertical polarized wave) at 5887.5 MHz is shown in FIG. 44, and the average gain is 3.00 dBi.

Figure 45A:
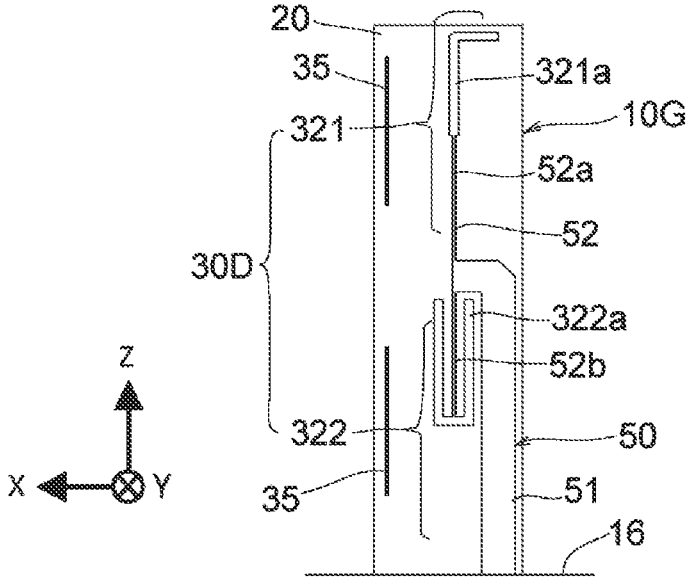
FIG. 45A A diagram illustrating a first surface of an array antenna substrate according to an eighth embodiment in the case of configuring a linear polarized wave array antenna device for vehicle as an antenna device for vehicle according to the present invention.
Figure 45B:
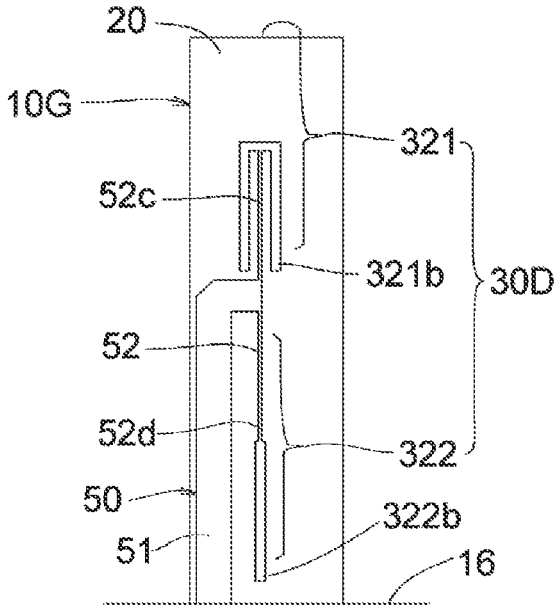
FIG. 45B A diagram illustrating a second surface of the array antenna substrate according to the eighth embodiment.

FIG. 45A and FIG. 45B show an array antenna substrate 10G according to an eighth embodiment in the case of configuring a linear polarized wave array antenna device for vehicle as an antenna device for vehicle according to the present invention. A difference between this array antenna substrate 10G and the array antenna substrate 10F shown in the seventh embodiment is that wave directors 35 are disposed in parallel with the dipole antennas 321 and 322, respectively. Since the wave directors 35 are disposed, it is possible to increase the directivity gain of the side where the wave directors 35 are disposed. For example, if the array antenna substrate 10G is mounted on the base 15 such that the wave directors 35 are positioned on the rear side, it has directivity in which high gain is obtained in the opposite direction to the traveling direction of the automobile.

Figure 46:
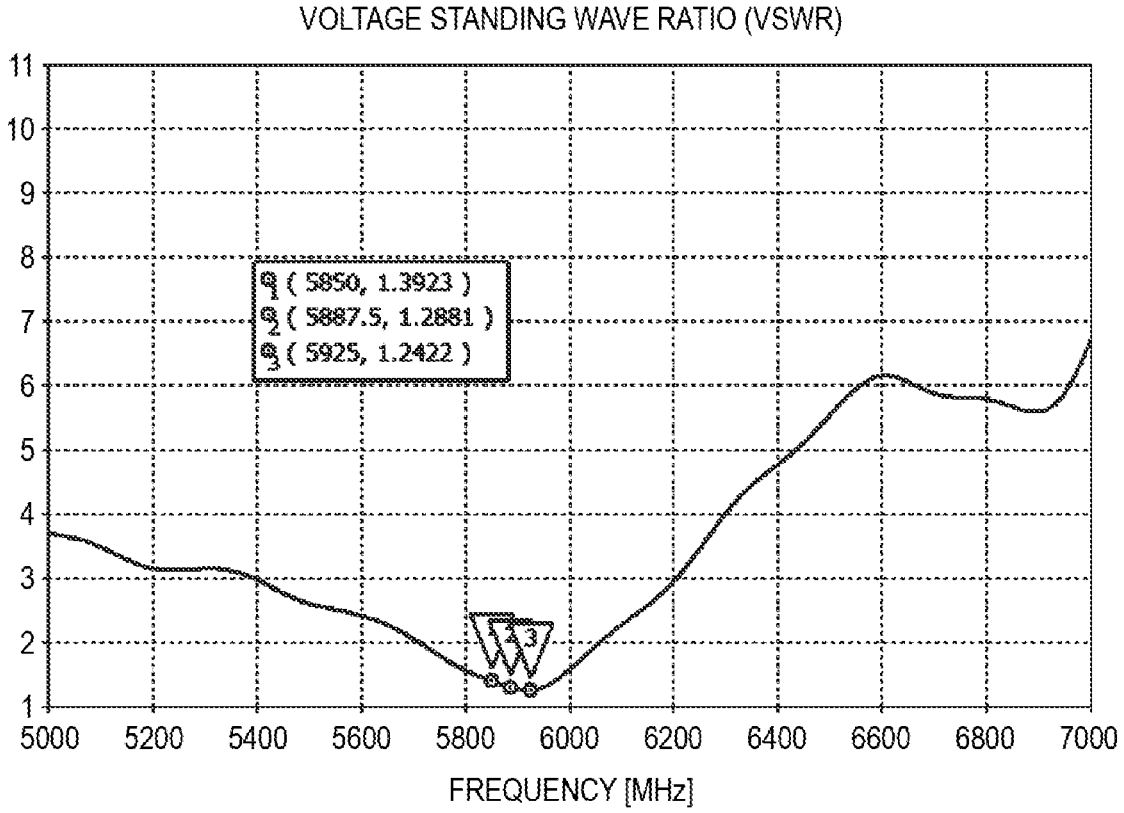
FIG. 46 A graph illustrating a VSWR-frequency characteristic in the case of the eighth embodiment.
Figure 47:
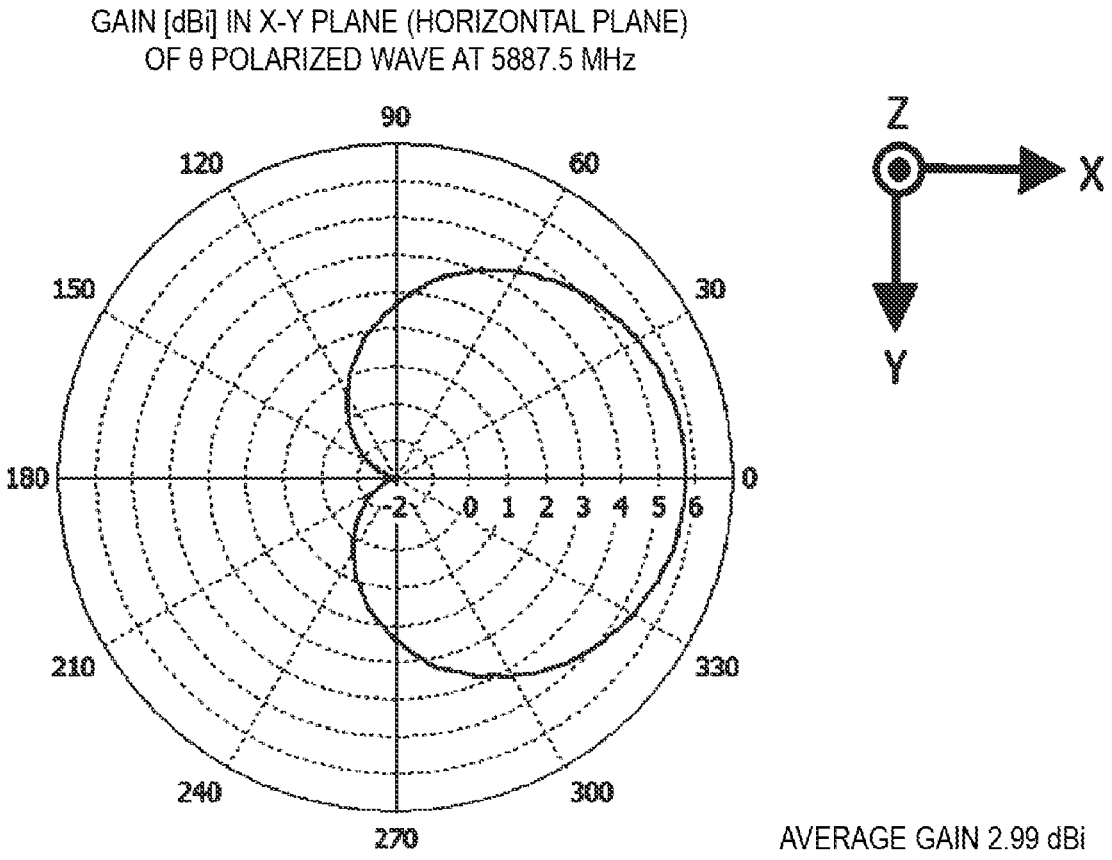
FIG. 47 A graph illustrating the gain of θ polarized wave at 5887.5 MHz in the case of the eighth embodiment.

In the case of the eighth embodiment shown in FIG. 45A and FIG. 45B, as shown in FIG. 46, the VSWR is 1.3923 at 5850 MHz, and is 1.2881 at 5887.5 MHz, and is 1.2422 at 5925 MHz. Also, the gain in X-Y plane (horizontal plane) of θ polarized wave (vertical polarized wave) at 5887.5 MHz is shown in FIG. 47, and the average gain is 2.99 dBi.

Also, in the eighth embodiment, the configuration in which the wave directors 35 are provided on the first surface of the dielectric substrate 20 has been described; however, wave directors 35 may be provided on the second surface, and wave directors 35 may be provided on both of the first surface and the second surface.

In each embodiment of the present invention, as the distributors formed on the transmission lines, the distributors having T bifurcations have been exemplified; however, other distribution means may be used.

Also, in the fourth embodiment of the present invention, the array antenna substrate is configured by providing the plurality of dipole antenna arrays on one dielectric substrate; however, an antenna device for vehicle may be configured by combining a plurality of array antenna substrates each of which has one dipole antenna array.

The mounting position of the antenna device for vehicle of the present invention is not limited to the top of the roof of a vehicle body, and the antenna device for vehicle may be disposed in any other position, for example, inside a vehicle.

DESCRIPTION OF REFERENCE NUMERALS

1 Monopole Antenna
2 Sleeve Antenna
3 Circular Ground Plate
10, 10A, 10B, 10C, 10D, 10E, 10F, 10G Antenna Substrate
15 Base
16 Mounting Substrate (Mounting Member)
17 Case
20 Dielectric Substrate
21, 22 Conductor Pattern
23 Conductor Land
24 Through-Hole
35 Wave Director
36 Reflector
30, 30A, 30B, 30C, 30D Dipole Antenna Array
31, 311, 312, 321, 322 Dipole Antenna
40, 50 Transmission Line
41, 51 Common Transmission Line Part
42, 52 Branch Transmission Line Part

The invention claimed is:

1. An antenna device for vehicle comprising:

one or more dipole antenna arrays in which a plurality of dipole antennae which includes conductor patterns provided on a substrate are arranged; and two parallel transmission lines including conductor patterns provided on the substrate, wherein the transmission lines include a common transmission line part which is used in common for power-feeding to all of the dipole antennae, and branch transmission line parts which branch from the common transmission line part and are used for power-feeding to the respective dipole antennae, wherein adjacent branch transmission line parts of the branch transmission line parts extend from a connection position with the common transmission line part in directions away from each other, and wherein at least one of the dipole antennae is inclined with respect to an arrangement direction of the other of the dipole antennae.

2. The antenna device for vehicle according to claim 1, wherein the dipole antenna arrays include a pair of dipole antenna arrays, wherein on one side of the substrate in a width direction of the substrate, one of the dipole antenna arrays is disposed, and wherein on the other side of the substrate in the width direction of the substrate, the other of the dipole antenna arrays is disposed.

3. The antenna device for vehicle according to claim 2, wherein in the dipole antenna arrays, the plurality of dipole antennae are arranged in a straight line, and wherein when a free space wavelength of radio transmission or reception waves is λ, an interval between one of the dipole antenna arrays and the other of the dipole antenna arrays is λ/2.

4. The antenna device for vehicle according to claim 1, wherein on the substrate, a conductor pattern which constitutes a wave director or a reflector is provided in parallel with at least one of the dipole antenna arrays.

5. The antenna device for vehicle according to claim 1, wherein in the dipole antenna arrays, the plurality of dipole antennae are arranged in a straight line.

6. The antenna device for vehicle according to claim 1, wherein the two parallel transmission lines have a structure in which a pair of conductor patterns face each other across the substrate interposed between the pair of the conductor patterns.

7. The antenna device for vehicle according to claim 6, wherein a conductor pattern provided on one surface of the substrate and constituting one side element of the dipole antennae is connected to one of the conductor patterns of the transmission lines, provided on said one surface of the substrate, and wherein a conductor pattern provided on the other surface of the substrate and constituting the other side element of the dipole antennae is connected to the other of the conductor patterns of the transmission lines, provided on the other surface of the substrate.

8. The antenna device for vehicle according to claim 6, wherein a conductor pattern provided on one surface of the substrate and constituting one side element of the dipole antennae is connected to one of the conductor patterns of the transmission lines, provided on said one surface of the substrate, and wherein the other of the conductor patterns of the transmission lines, provided on the other surface of the substrate is surrounded by a conductor pattern provided on the other surface of the substrate and constituting the other side element of the dipole antennae.

9. The antenna device for vehicle according to claim 1, wherein the substrate is mounted vertically on a mounting member fixed on a base, and wherein a case is put on the base from above so as to cover the substrate.

10. The antenna device for vehicle according to claim 9, wherein both surfaces of the substrate have conductor lands which are fixed to the mounting member by soldering, and wherein the conductor lands are connected to each other via a through-hole.

11. The antenna device for vehicle according to claim 1, wherein the common transmission line part is a reflector.

12. The antenna device for vehicle according to claim 1, wherein a position of a connection part between at least one of the dipole antennae and the transmission lines is different from a position of a connection part between the other of the dipole antennae and the transmission lines, in a direction perpendicular to an arrangement direction of the other of the dipole antennae.

13. The antenna device for vehicle according to claim 1, wherein the connection position with the adjacent branch transmission line parts and the common transmission line part is a same connection position, and the adjacent branch transmission line parts extend from the same connection position in diverging directions.

14. The antenna device for vehicle according to claim 1, wherein the transmission lines are configured such that both power feeding to power feeding parts of the transmission lines via balanced lines and power feeding to the power feeding parts of the transmission lines via unbalanced lines can be performed.

15. The antenna device for vehicle according to claim 1, wherein at least a portion of the branch transmission line parts is parallel with the common transmission line part.

16. An antenna device for vehicle comprising:

one or more dipole antenna arrays in which a plurality of dipole antennae which includes conductor patterns provided on a substrate are arranged; and two parallel transmission lines including conductor patterns provided on the substrate, wherein each of the dipole antennae is power-fed via the transmission lines, wherein the transmission lines include a common transmission line part that feeds the dipole antennae on one side of the substrate, wherein at least a portion of the common transmission line part is offset from a center axis of the substrate, and wherein at least one of the dipole antennae is inclined with respect to an arrangement direction of the other of the dipole antennae.

17. The antenna device for vehicle according to claim 16, wherein the transmission lines include the common transmission line part and a branch transmission line part that interconnects the common transmission line part with at least one dipole antenna, at least a portion of the branch transmission line part being parallel with the common transmission line part.

* * * * *